US008685179B2

(12) United States Patent
Tsuchiya et al.

(10) Patent No.: US 8,685,179 B2
(45) **Date of Patent: *Apr. 1, 2014**

(54) FE-BASED AMORPHOUS ALLOY, POWDER CORE USING THE SAME, AND COIL ENCAPSULATED POWDER CORE

(75) Inventors: Keiko Tsuchiya, Niigata-ken (JP); Hisato Koshiba, Niigata-ken (JP); Kazuya Kaneko, Niigata-ken (JP); Seiichi Abiko, Niigata-ken (JP); Takao Mizushima, Niigata-ken (JP)

(73) Assignee: Alps Green Devices Co., Ltd., Tokyo (JP)

( * ) Notice: Subject to any disclaimer, the term of this patent is extended or adjusted under 35 U.S.C. 154(b) by 73 days.

This patent is subject to a terminal disclaimer.

(21) Appl. No.: 13/330,420

(22) Filed: Dec. 19, 2011

(65) Prior Publication Data

US 2012/0092111 A1 Apr. 19, 2012

Related U.S. Application Data

(63) Continuation of application No. PCT/JP2010/058028, filed on May 12, 2010.

(30) Foreign Application Priority Data

Aug. 7, 2009 (JP) ..... 2009-184974

(51) Int. Cl.
*C22C 45/02* (2006.01)

(52) U.S. Cl.
CPC ..... *C22C 45/02* (2013.01); *C22C 2200/02* (2013.01)
USPC ..... 148/304; 148/403; 420/9; 420/100; 420/112

(58) Field of Classification Search
None
See application file for complete search history.

(56) References Cited

U.S. PATENT DOCUMENTS

| | | | | |
|---|---|---|---|---|
| 6,083,325 | A | 7/2000 | Bitoh et al. | |
| 6,270,592 | B1 | 8/2001 | Nakajima et al. | |
| 6,594,157 | B2 * | 7/2003 | Yoshida et al. | 363/14 |
| 7,277,001 | B2 * | 10/2007 | Mizushima et al. | 336/192 |
| 7,501,925 | B2 * | 3/2009 | Naito et al. | 336/233 |

(Continued)

FOREIGN PATENT DOCUMENTS

| | | |
|---|---|---|
| JP | 57-185957 | 11/1982 |
| JP | 63-117406 | 5/1988 |

(Continued)

OTHER PUBLICATIONS

Notice of Allowance dated Aug. 8, 2012 from U.S. Appl. No. 13/180,424.

(Continued)

*Primary Examiner* — George Wyszomierski
(74) *Attorney, Agent, or Firm* — Beyer Law Group LLP

(57) ABSTRACT

An Fe-based amorphous alloy of the present invention has a composition formula represented by $Fe_{100-a-b-c-x-y-z-t}Ni_aSn_bCr_cP_xC_yB_zSi_t$, and in the formula, 0 at %≤a≤10 at %, 0 at %≤b≤3 at %, 0 at %≤c≤6 at %, 6.8 at %≤x≤10.8 at %, 2.2 at %≤y≤9.8 at %, 0 at %≤z≤4.2 at %, and 0 at %≤t≤3.9 at % hold. Accordingly, an Fe-based amorphous alloy used for a powder core and/or a coil encapsulated powder core having a low glass transition temperature (Tg), a high conversion vitrification temperature (Tg/Tm), and excellent magnetization and corrosion resistance can be manufactured.

17 Claims, 14 Drawing Sheets

(56) References Cited

U.S. PATENT DOCUMENTS

| | | | | |
|---|---|---|---|---|
| 8,007,600 | B2 | 8/2011 | Ohta et al. | |
| 8,147,622 | B2 * | 4/2012 | Koshiba et al. | 148/304 |
| 8,313,588 | B2 * | 11/2012 | Iorio et al. | 148/304 |
| 2005/0236071 | A1 | 10/2005 | Koshiba et al. | |
| 2007/0258842 | A1 | 11/2007 | Lu et al. | |
| 2008/0142121 | A1 | 6/2008 | Koshiba et al. | |
| 2009/0266448 | A1 | 10/2009 | Ohta et al. | |
| 2010/0097171 | A1 | 4/2010 | Urata et al. | |
| 2010/0098576 | A1 | 4/2010 | Yoshizawa et al. | |
| 2010/0108196 | A1 | 5/2010 | Ohta et al. | |

FOREIGN PATENT DOCUMENTS

| | | |
|---|---|---|
| JP | 7-93204 | 10/1995 |
| JP | 8-153614 | 6/1996 |
| JP | 2672306 | 7/1997 |
| JP | 2002-151317 | 5/2002 |
| JP | 2002-226956 | 8/2002 |
| JP | 2003-213331 | 7/2003 |
| JP | 2004-156134 | 6/2004 |
| JP | 2005-307291 | 11/2005 |
| JP | 2007-254814 | 10/2007 |
| JP | 2008-169466 | 7/2008 |
| JP | 2008-248380 | 10/2008 |
| JP | 2009-7639 | 1/2009 |
| JP | 2009-54615 | 3/2009 |
| WO | WO 2008/114665 | 9/2008 |
| WO | WO 2008/133302 | 11/2008 |

OTHER PUBLICATIONS

Search Report dated Apr. 27, 2010 from International Application No. PCT/JP2010/050673.

U.S. Appl. No. 13/180,424, filed Jul. 11, 2011.

U.S. Office Action dated Mar. 26, 2012 from U.S. Appl. No. 13/180,424.

Search Report dated Aug. 10, 2010 from International Application No. PCT/JP210/058028.

* cited by examiner

FE-BASED AMORPHOUS ALLOY, POWDER CORE USING THE SAME, AND COIL ENCAPSULATED POWDER CORE

CLAIM OF PRIORITY

This application is a Continuation of International Application No. PCT/JP2010/058028 filed on May 12, 2010, which claims benefit of Japanese Patent Application No. 2009-184974 filed on Aug. 7, 2009. The entire contents of each application noted above are hereby incorporated by reference.

BACKGROUND OF THE INVENTION

1. Field of the Invention

The present invention relates to a Fe-based amorphous alloy applied, for example, to a powder core of a transformer, a power supply choke coil, or the like and a coil encapsulated powder core.

2. Description of the Related Art

Concomitant with recent trend toward a higher frequency and a larger current, a powder core and a coil encapsulated powder core, which are applied to electronic components and the like, are each required to have superior direct-current superposing characteristics, a low core loss, and a constant inductance in a frequency range up to MHz.

Incidentally, a heat treatment is performed on a powder core formed to have a targeted shape from an Fe-based amorphous alloy with a binding agent in order to reduce stress deformation generated when a powder of the Fe-based amorphous alloy is formed and/or stress deformation generated when the powder core is formed.

However, in consideration of the heat resistance of a coated lead wire, a binding agent, and the like, a temperature T1 of the heat treatment actually applied to a core molded body could not be increased to an optimum heat treatment temperature at which the stress deformation of the Fe-based amorphous alloy was effectively reduced, and the core loss could be minimized.

Accordingly, in the past, the optimum heat treatment temperature was high, (the optimum heat treatment temperature−the heat treatment temperature T1) was increased, the stress deformation of the Fe-based amorphous alloy could not be sufficiently reduced; hence, the characteristics thereof could not be fully utilized, and the core loss could not be sufficiently reduced.

Therefore, in order to decrease the optimum heat treatment temperature as compared to that in the past and to improve the core characteristics, a glass transition temperature (Tg) of the Fe-based amorphous alloy was necessarily decreased. In addition, at the same time, in order to improve amorphous formability, a conversion vitrification temperature (Tg/Tm) was necessarily increased, and furthermore, in order to improve the core characteristics, it was necessary to increase magnetization and to improve corrosion resistance.

The inventions disclosed in Japanese Unexamined Patent Application Publication Nos. 2008-169466, 2005-307291, 2004-156134, 2002-226956, 2002-151317, 57-185957, and 63-117406 all have not aimed to satisfy all of a low glass transition temperature (Tg), a high conversion vitrification temperature (Tg/Tm), and good magnetization and corrosion resistance, and hence, addition amounts of individual elements were not adjusted to satisfy the properties as described above.

SUMMARY OF THE INVENTION

Accordingly, the present invention is to solve the above related problems and in particular provides a Fe-based amorphous alloy which has a low glass transition temperature (Tg) and a high conversion vitrification temperature (Tg/Tm) so as to have a low optimum heat treatment temperature and which is used for a powder core or a coil encapsulated powder core with good magnetization and corrosion resistance.

Solution to Problem

An Fe-based amorphous alloy of the present invention is represented by a composition formula, Fe100-a-b-c-x-y-z-tNiaSnbCrcPxCyBzSit, and in the formula, 0 at %≤a≤10 at %, 0 at %≤b≤3 at %, 0 at %≤c≤6 at %, 6.8 at %≤x≤10.8 at %, 2.2 at %≤y≤9.8 at %, 0 at %≤z≤4.2 at %, and 0 at %≤t≤3.9 at % hold.

In the present invention, the glass transition temperature (Tg) cab be decreased, and the conversion vitrification temperature (Tg/Tm) can be increased, and further more, high magnetization and excellent corrosion resistance can be obtained.

In particular, the glass transition temperature (Tg) can be set to 740K or less, and the conversion vitrification temperature (Tg/Tm) can be set to 0.52 or more (preferably 0.54 or more). In addition, a saturation mass magnetization σs can be set to 140 (×10−6 Wbm/kg) or more, and a saturation magnetization Is can be set to 1T or more.

In the present invention, only one of Ni and Sn is preferably added.

The addition of Ni can decrease the glass transition temperature (Tg) and can maintain the conversion vitrification temperature (Tg/Tm) at a high value. In the present invention, Ni in an amount of up to 10 at % can be added.

In addition, since the present invention aims to decrease the glass transition temperature (Tg) while high magnetization is maintained, the addition amount of Sn is decreased as small as possible. That is, since the addition of Sn degrades the corrosion resistance, the addition of Cr must be simultaneously performed to a certain extent. Accordingly, even if the glass transition temperature (Tg) can be decreased, since the magnetization is liable to be degraded by the addition of Cr, the addition amount of Sn is preferably decreased. In addition, in the present invention, as shown in experiments which will be described later, when Ni and Sn are added, only one of Ni and Sn is added. As a result, a decrease in glass transition temperature (Tg) and an increase in conversion vitrification temperature (Tg/Tm) can be effectively performed, and furthermore, high magnetization and corrosion resistance can be obtained.

In addition, in the present invention, the addition amount a of Ni is preferably in a range of 0 and 6 at %. Accordingly, the amorphous formability can be improved.

In addition, in the present invention, the addition amount a of Ni is more preferably in a range of 4 to 6 at %. Accordingly, the glass transition temperature (Tg) can be more effectively decreased, and a high conversion vitrification temperature (Tg/Tm) and Tx/Tm can be stably obtained.

In addition, in the present invention, the addition amount b of Sn is preferably in a range of 0 to 2 at %. Accordingly, degradation in corrosion resistant can be more effectively suppressed, and the amorphous formability can be maintained high.

In addition, in the present invention, the addition amount c of Cr is preferably in a range of 0 to 2 at %. In addition, in the present invention, the addition amount c of Cr is more preferably in a range of 1 to 2 at %. Accordingly, more effectively, a low glass transition temperature (Tg) can be maintained, and high magnetization and corrosion resistance can also be obtained.

In addition, in the present invention, the addition amount x of P is preferably in a range of 8.8 to 10.8 at %. In the present invention, in order to decrease the glass transition temperature (Tg) and to improve the amorphous formability represented by the conversion vitrification temperature (Tg/Tm), it is necessary to decrease a melting point (Tm), and by the addition of P, the melting point (Tm) can be decreased. In addition, in the present invention, when the addition amount x of P is set in a range of 8.8 to 10.8 at %, more effectively, the melting point (Tm) can be decreased, and the conversion vitrification temperature (Tg/Tm) can be increased.

In addition, in the present invention, the addition amount y of C is preferably in a range of 5.8 to 8.8 at %. Accordingly, more effectively, the melting point (Tm) can be decreased, and the conversion vitrification temperature (Tg/Tm) can be increased.

In addition, in the present invention, the addition amount z of B is preferably in a range of 0 to 2 at %. Accordingly, more effectively, the glass transition temperature (Tg) can be decreased.

In addition, in the present invention, the addition amount z of B is preferably in a range of 1 to 2 at %.

In addition, in the present invention, the addition amount t of Si is preferably in a range of 0 to 1 at %. Accordingly, more effectively, the glass transition temperature (Tg) can be decreased.

In addition, in the present invention, (the addition amount z of B+the addition amount t of Si) is preferably in a range of 0 to 4 at %. Accordingly, effectively, the glass transition temperature (Tg) can be decreased to 740K or less. In addition, high magnetization can be maintained.

In addition, in the present invention, it is preferable that the addition amount z of B be in a range of 0 to 2 at %, the addition amount t of Si be in a range of 0 to 1 at %, and (the addition amount z of B+the addition amount t of Si) be in a range of 0 to 2 at %. Accordingly, the glass transition temperature (Tg) can be decreased to 710K or less.

Alternatively, in the present invention, it is more preferable that the addition amount z of B be in a range of 0 to 3 at %, the addition amount t of Si be in a range of 0 to 2 at %, and (the addition amount z of B+the addition amount t of Si) be in a range of 0 to 3 at %. Accordingly, the glass transition temperature (Tg) can be decreased to 720K or less.

In addition, in the present invention, the addition amount t of Si/(the addition amount t of Si+the addition amount x of P) is preferably in a range of 0 to 0.36. Accordingly, more effectively, the glass transition temperature (Tg) can be decreased, and the conversion vitrification temperature (Tg/Tm) can be increased.

In addition, in the present invention, the addition amount t of Si/(the addition amount t of Si+the addition amount x of P) is more preferably in a range of 0 to 0.25.

In addition, a powder core of the present invention is formed from a powder of the Fe-based amorphous alloy described above by solidification with a binding agent.

Alternatively, a coil encapsulated powder core of the present invention includes a powder core formed from a powder of the Fe-based amorphous alloy described above by solidification with a binding agent and a coil covered with the powder core.

In the present invention, the optimum heat treatment temperature of the core can be decreased, the inductance can be increased, and the core loss can be reduced, and when mounting is performed in a power supply, power supply efficiency (η) can be improved.

In addition, in the coil encapsulated powder core according to the present invention, since the optimum heat treatment temperature of the Fe-based amorphous alloy can be decreased, the stress deformation can be appropriately reduced at a heat treatment temperature lower than a heat resistant temperature of the binding agent, and a magnetic permeability μ of the powder core can be increased; hence, by using an edgewise coil having a larger cross-sectional area of a conductor in each turn than that of a round wire coil, a desired high inductance can be obtained with a smaller turn number. As described above, in the present invention, since the edgewise coil having a large cross-sectional area of a conductor in each turn can be used as the coil, a direct current resistance Rdc can be decreased, and heat generation and copper loss can both be suppressed.

DESCRIPTION OF THE PREFERRED EMBODIMENTS

Figure 1:
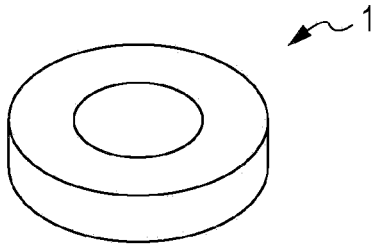
FIG. 1 is a perspective view of a powder core.

An Fe-based amorphous alloy according to this embodiment is represented by a composition formula, Fe100-a-b-c-x-y-z-tNiaSnbCrcPxCyBzSit, and in the formula, 0 at %≤a≤≤10 at %, 0 at %≤b≤3 at %, 0 at %≤c≤6 at %, 6.8 at %≤x≤10.8 at %, 2.2 at %≤y≤9.8 at %, 0 at %≤z≤4.2 at %, and 0 at %≤t≤3.9 at % hold.

As described above, the Fe-based amorphous alloys of this embodiment is a soft magnetic alloy including Fe as a primary component and Ni, Sn, Cr, P, C, B, and Si added thereto (however, Ni, Sn, Cr, B, and Si are arbitrarily added).

In addition, in order to further increase the saturation magnetic flux density and/or to adjust the magnetostriction, a mixed phase texture of an amorphous phase as a primary phase and an α-Fe crystal phase may also be formed. The α-Fe crystal phase has the bcc structure.

An addition amount of Fe contained in the Fe-based amorphous alloy of this embodiment is represented by (100-a-b-c-x-y-z-t) of the above composition formula and is in a range of approximately 65.9 to 77.4 at % in experiments which will be described later. When the amount of Fe is high as described above, high magnetization can be obtained.

The addition amount a of Ni contained in the Fe-based amorphous alloy is set in a range of 0 to 10 at %. By the addition of Ni, a glass transition temperature (Tg) can be decreased, and a conversion vitrification temperature (Tg/Tm) can be maintained at a high value. In this embodiment, Tm indicates the melting point. An amorphous material can be obtained even if the addition amount a of Ni is increased to approximately 10 at %. However, when the addition amount a of Ni is more than 6 at %, the conversion vitrification temperature (Tg/Tm) and Tx/Tm (in this case, Tx indicates a crystallization starting temperature) are decreased, and the amorphous formability is degraded. Hence, in this embodiment, the addition amount a of Ni is preferably in a range of 0 to 6 at %, and if it is set in a range of 4 to 6 at %, a low glass transition temperature (Tg) and a high conversion vitrification temperature (Tg/Tm) can be stably obtained. In addition, high magnetization can be maintained.

The addition amount b of Sn contained in the Fe-based amorphous alloy is set in a range of 0 to 3 at %. An amorphous material can be obtained even if the addition amount b of Sn is increased to approximately 3 at %. However, an oxygen concentration in an alloy powder is increased by the addition of Sn, and hence, the corrosion resistance is liable to be degraded. Therefore, the addition amount of Sn is decreased to the necessary minimum. In addition, when the addition amount b of Sn is set to approximately 3 at %, since Tx/Tm is remarkably decreased, and the amorphous formability is degraded, a preferable range of the addition amount b of Sn is set in a range of 0 to 2 at %. Alternatively, since high Tx/Tm can be maintained, the addition amount b of Sn is more preferably set in a range of 1 to 2 at %.

In addition, in this embodiment, it is preferable that neither Ni nor Sn be added to the Fe-based amorphous alloy, or only one of Ni and Sn be added thereto.

For example, according to the invention disclosed in Japanese Unexamined Patent Application Publication No. 2008-169466, many examples in which Sn and Ni are simultaneously added have been described. In addition, an effect of simultaneous addition has also been disclosed, for example, in paragraph [0043] of Japanese Unexamined Patent Application Publication No. 2008-169466, and evaluation was conducted fundamentally based on the points of the amorphous formability and the decrease in annealing treatment (heat treatment) temperature.

On the other hand, in this embodiment, when Ni or Sn is added, only one of them is added, and it is intended to increase the magnetization and improve the corrosion resistance besides a low glass transition temperature (Tg) and a high conversion vitrification temperature (Tg/Tm). According to this embodiment, high magnetization can be obtained as compared to that of the Fe-based amorphous alloy of Japanese Unexamined Patent Application Publication No. 2008-169466.

In addition, instead of using Sn, at least one of In, Zn, Ga, Al, and the like may be added as an element which decreases the heat treatment temperature in a manner similar to that of Sn. However, In and Ga are expensive, Al is difficult to be formed into uniform spherical powder grains by water atomization as compared to Sn, and Zn may increase the melting point of the whole alloy since having a high melting point as compared to that of Sn; hence, among those elements described above, Sn is more preferably selected.

The addition amount c of Cr contained in the Fe-based amorphous alloy is set in a range of 0 to 6 at %. Cr can form a passive oxide film on the alloy and can improve the corrosion resistance of the Fe-based amorphous alloy. For example, corrosion portions are prevented from being generated when a molten alloy is directly brought into contact with water in a step of forming an Fe-based amorphous alloy powder using a water atomizing method and further in a step of drying the Fe-based amorphous alloy powder after the water atomization. On the other hand, by the addition of Cr, since the glass transition temperature (Tg) is increased, and a saturation mass magnetization σs and a saturation magnetization Is are decreased, it is effective to decrease the addition amount c of Cr to the necessary minimum. In particular, when the addition amount c of Cr is set in a range of 0 to 2 at %, it is preferable since the glass transition temperature (Tg) can be maintained low.

Furthermore, the addition amount c of Cr is more preferably adjusted in a range of 1 to 2 at %. Besides excellent corrosion resistance, the glass transition temperature (Tg) can be maintained low, and high magnetization can be maintained.

The addition amount x of P contained in the Fe-based amorphous alloy is set in a range of 6.8 to 10.8 at %. In addition, the addition amount y of C contained in the Fe-based amorphous alloy is set in a range of 2.2 to 9.8 at %. An amorphous material can be obtained since the addition amounts of P and C are set in the respective ranges described above.

In addition, in this embodiment, although the glass transition temperature (Tg) of the Fe-based amorphous alloy is decreased, and the conversion vitrification temperature (Tg/Tm) used as an index of the amorphous formability is simultaneously increased, since the glass transition temperature (Tg) is decreased, in order to increase the conversion vitrification temperature (Tg/Tm), the melting point (Tm) must be decreased.

In this embodiment, in particular, by adjusting the addition amount x of P in a range of 8.8 to 10.8 at %, the melting point (Tm) can be effectively decreased, and the conversion vitrification temperature (Tg/Tm) can be increased.

In general, among half metals, P is known as an element which is liable to decrease the magnetization, and in order to obtain high magnetization, it is necessary to decrease the addition amount to some extent. In addition, when the addition amount x of P is set to 10.8 at %, the composition is close to an eutectic composition (Fe79.4P10.8C9.8) of an Fe—P—C ternary alloy. Hence, when P in an amount of more than 10.8 at % is added, the melting point (Tm) is increased thereby. Accordingly, the upper limit of the addition amount of P is preferably set to 10.8 at %. On the other hand, in order to effectively decrease the melting point (Tm) and increase the conversion vitrification temperature (Tg/Tm) as described above, P in an amount of 8.8 at % or more is preferably added.

In addition, the addition amount y of C is preferably adjusted in a range of 5.8 to 8.8 at %. As a result, effectively, the melting point (Tm) can be decreased, the conversion vitrification temperature (Tg/Tm) can be increased, and the magnetization can be maintained at a high value.

The addition amount z of B contained in the Fe-based amorphous alloy is set in a range of 0 to 4.2 at %. In addition, the addition amount t of Si contained in the Fe-based amorphous alloy is set in a range of 0 to 3.9 at %.

Accordingly, an amorphous material can be obtained, and the glass transition temperature (Tg) can be suppressed low.

In particular, the glass transition temperature (Tg) of the Fe-based amorphous alloy can be set to 740K (Kelvin) or less. However, since the magnetization is decreased when more than 4.2 at % of B is added, the upper limit thereof is preferably set to 4.2 at %.

In addition, in this embodiment, (the addition amount z of B+the addition amount t of Si) is preferably in a range of 0 to 4 at %. Accordingly, the glass transition temperature (Tg) of the Fe-based amorphous alloy can be effectively set or 740K or less. In addition, high magnetization can be maintained.

In addition, in this embodiment, when the addition amount z of B is set in a range of 0 to 2 at %, and the addition amount t of Si is set to 0 to 1 at %, the glass transition temperature (Tg) can be more effectively decreased. Furthermore, when (the addition amount z of B+the addition amount t of Si) is also set in a range of 0 to 2 at %, the glass transition temperature (Tg) can be set to 710K or less.

Alternatively, in this embodiment, when the addition amount z of B is set in a range of 0 to 3 at %, the addition amount t of Si is in a range of 0 to 2 at %, and (the addition amount z of B+the addition amount t of Si) is set in a range of 0 to 3 at %, the glass transition temperature (Tg) can be decreased to 720K or less.

In examples of the inventions disclosed Japanese Unexamined Patent Application Publication Nos. 2005-307291, 2004-156134, and 2002-226956, the addition amount of B is relatively high as compared to that of this embodiment, and in addition, (the addition amount z of B+the addition amount t of Si) is also larger than that of this embodiment. In addition, in the invention disclosed in Japanese Unexamined Patent Application Publication No. 57-185957, (the addition amount z of B+the addition amount t of Si) is also larger than that of this embodiment.

Although the addition of Si and B is useful for improvement in amorphous formability, since the glass transition temperature (Tg) is liable to be increased, in this embodiment, in order to decrease the glass transition temperature (Tm) as low as possible, the addition amounts of Si, B, and Si+B are each decreased to the necessary minimum level. Furthermore, since B is contained as an essential element, the amorphous formation can be promoted, and at the same time, an amorphous alloy having a large grain size can be stably obtained.

Further, in this embodiment, the glass transition temperature (Tg) can be decreased, and simultaneously, the magnetization can also be increased.

In addition, in this embodiment, the addition amount t of Si/(the addition amount t of Si+the addition amount x of P) is preferably in a range of 0 to 0.36. In addition, the addition amount t of Si/(the addition amount t of Si+the addition amount x of P) is more preferably in a range of 0 to 0.25.

In the invention disclosed in Japanese Unexamined Patent Application Publication No. 2005-307291, although the value of the addition amount t of Si/(the addition amount t of Si+the addition amount x of P) is also defined, in this embodiment, the value of the addition amount t of Si/(the addition amount t of Si+the addition amount x of P) can be set lower than that disclosed in Japanese Unexamined Patent Application Publication No. 2005-307291.

In this embodiment, when the addition amount t of Si/(the addition amount t of Si+the addition amount x of P) is set in the range described above, more effectively, the glass transition temperature (Tg) can be decreased, and the conversion vitrification temperature (Tg/Tm) can be increased.

In addition, in Japanese Unexamined Patent Application Publication No. 2002-226956, although the addition amount t of Si/(the addition amount t of Si+the addition amount x of P) is also defined, Al is used as an essential element, and the constituent elements are different from those of this embodiment. In addition, for example, the content of B is also different from that of this embodiment. In addition, in the invention disclosed in Japanese Unexamined Patent Application Publication No. 2002-15131, Al is also used as an essential element.

The Fe-based amorphous alloy of this embodiment is represented by a composition formula, Fe100-c-x-y-z-tCrcPxCyBzSit, and 1 at %≤c≤2 at %, 8.8 at %≤x≤10.8 at %, 5.8 at %≤y≤8.8 at %, 1 at %≤z≤2 at %, and 0 at %≤t≤1 at % are more preferably satisfied.

Accordingly, the glass transition temperature (Tg) can be set to 720K or less, the conversion vitrification temperature (Tg/Tm) can be set to 0.57 or more, the saturation magnetization Is can be set to 1.25 or more, and the saturation mass magnetization σs can be set to 175×10−6 Wbm/kg or more.

In addition, the Fe-based amorphous alloy of this embodiment is represented by a composition formula, Fe100-a-c-x-y-z-tNiaCrcPxCyBzSit, and 4 at %≤a≤6 at %, 1 at %≤c≤2 at %, 8.8 at %≤x≤10.8 at %, 5.8 at %≤y≤8.8 at %, 1 at %≤z≤2 at %, and 0 at %≤t≤1 are more preferably satisfied.

Accordingly, the glass transition temperature (Tg) can be set to 705K or less, the conversion vitrification temperature (Tg/Tm) can be set to 0.56 or more, the saturation magnetization Is can be set to 1.25 or more, and the saturation mass magnetization σs can be set to 170×10−6 Wbm/kg or more.

In addition, the Fe-based amorphous alloy of this embodiment is represented by a composition formula, Fe100-a-c-x-y-zNiaCrcPxCyBz, and 4 at %≤a≤6 at %, 1 at %≤c≤2 at %, 8.8 at %≤x≤10.8 at %, 5.8 at %≤y≤8.8 at %, and 1 at %≤z≤2 at % are more preferably satisfied.

Accordingly, the glass transition temperature (Tg) can be set to 705K or less, the conversion vitrification temperature (Tg/Tm) can be set to 0.56 or more, the saturation magnetization Is can be set to 1.25 or more, and the saturation mass magnetization σs can be set to 170×10−6 Wbm/kg or more.

In addition, in the Fe-based amorphous alloy of this embodiment, ΔTx=Tx−Tg can be set to approximately 20K or more, ΔTx can be set to 40K or more depending on the composition, and the amorphous formability can be further improved.

According to this embodiment, the Fe-based amorphous alloy represented by the above composition formula can be manufactured into a powder form, for example, by an atomizing method or into a belt shape (ribbon shape) by a liquid quenching method.

In addition, in the Fe-based amorphous alloy of this embodiment, small amounts of elements, such as Ti, Al, and Mn, may also be contained as inevitable impurities.

Figure 2A:
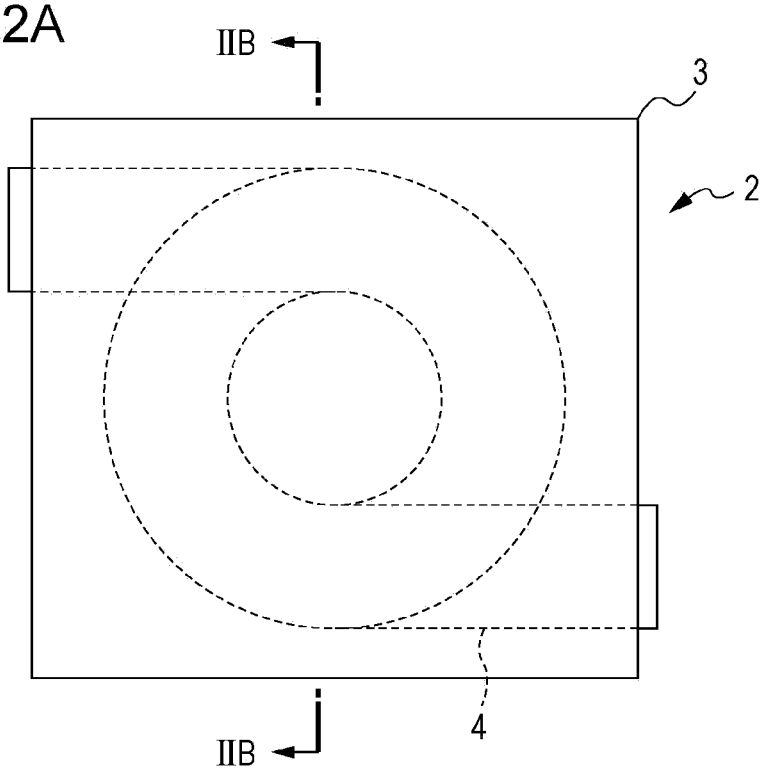
FIG. 2A is a plan view of a coil encapsulated powder core.
Figure 2B:
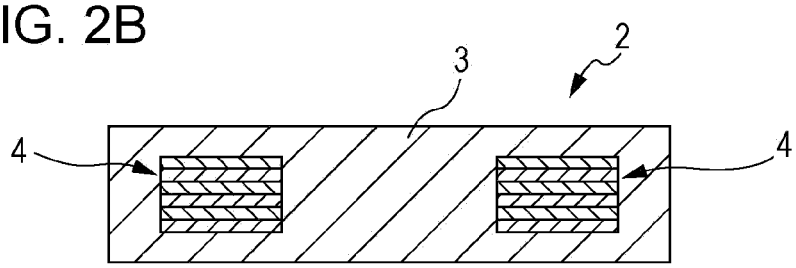
FIG. 2B is a longitudinal cross-sectional view of the coil encapsulated powder core which is taken along the line IIB-IIB shown in FIG. 2A and viewed in an arrow direction.

The Fe-based amorphous alloy powder of this embodiment may be applied, for example, to an annular powder core 1 shown in FIG. 1 or a coil encapsulated powder core 2 shown in FIGS. 2A and 2B, each of which is formed by solidification with a binding agent.

A coil encapsulated core (inductor element) 2 shown in FIGS. 2A and 2B is formed of a powder core 3 and a coil 4 covered with the powder core 3.

Fe-based amorphous alloy powder grains each have an approximately spherical or ellipsoidal shape. Many Fe-based amorphous alloy powder grains are present in the core and are insulated from each other with the binding agent provided therebetween.

In addition, as the binding agent, for example, there may be mentioned liquid or powdered resins or rubbers, such as an epoxy resin, a silicone resin, a silicone rubber, a phenol resin, a urea resin, a melamine resin, a polyvinyl alcohol (PVA), and an acrylate resin; water glass (Na20-SiO2); oxide glass powders (Na20-B203-SiO2, PbO—B203-SiO2, PbO—BaO—SiO2, Na2O—B203-ZnO, CaO—BaO—SiO2, Al203-B203-SiO2, and B203-SiO2); and glassy materials (containing, for example, SiO2, Al203, ZrO2, and/or TiO2 as a primary component) produced by a sol gel method.

In addition, as a lubricant, for example, zinc stearate and aluminum stearate may be used. A mixing ratio of the binding agent is 5 percent by mass or less, and the addition amount of the lubricant is approximately 0.1 to 1 percent by mass.

Although after press molding of the powder core is performed, a heat treatment is performed in order to reduce the stress deformation of the Fe-based amorphous alloy powder, in this embodiment, since the glass transition temperature (Tg) of the Fe-based amorphous alloy can be decreased, the optimum heat treatment temperature of the core can be decreased as compared to that in the past. The "optimum heat treatment temperature" in this embodiment is a heat treatment temperature applied to a core molded body which can effectively reduce the stress deformation of the Fe-based amorphous alloy powder and can minimize the core loss. For example, in an atmosphere of an inert gas, such as a N2 gas or an Ar gas, when the temperature reaches a predetermined heat treatment temperature at a temperature rise rate of 40° C./min, this heat treatment temperature is maintained for 1 hour, and subsequently, a heat treatment temperature at which a core loss W is minimized is defined as the optimum heat treatment temperature.

A heat treatment temperature T1 to be applied after the powder core is formed is set to a lower temperature than an optimum heat treatment temperature T2 in consideration, for example, of the heat resistance of the resin. In addition, in this embodiment, since the optimum heat treatment temperature T2 can be set lower than that in the past, (the optimum heat treatment temperature T2−the heat treatment temperature T1 after the core formation) can be made small as compared to that in the past.

Hence, in this embodiment, by a heat treatment at the heat treatment temperature T1 performed after the core formation, the stress deformation of the Fe-based amorphous alloy powder can also be effectively reduced as compared to that in the past, and in addition, since the Fe-based amorphous alloy of this embodiment maintains high magnetization, a desired inductance is not only ensured, but the core loss (W) can also be decreased, thereby obtaining a high power supply efficiency (η) when mounting is performed in a power supply.

In particular, according to this embodiment, in the Fe-based amorphous alloy, the glass transition temperature (Tg) can be set to 740K or less and preferably set to 710K or less. In addition, the conversion vitrification temperature (Tg/Tm) can be set to 0.52 or more, preferably set to 0.54 or more, and more preferably set to 0.56 or more. In addition, the saturation mass magnetization σs can be set to 140 (×10−6 Wbm/kg) or more, and the saturation magnetization Is can be set to 1T or more.

In addition, as the core characteristics, the optimum heat treatment temperature can be set to 693.15K (420° C.) or less and preferably set to 673.15K (400° C.) or less. In addition, the core loss W can be set to 90 (kW/m3) or less and preferably set to 60 (kW/m3) or less.

According to this embodiment, as shown in the coil encapsulated powder core 2 of FIG. 2B, an edgewise coil can be used for the coil 4. The edgewise coil indicates a coil formed by wiring a rectangular wire in a longitudinal direction by using a shorter side thereof as an inner diameter surface of the coil.

According to this embodiment, since the optimum heat treatment temperature of the Fe-based amorphous alloy can be decreased, the stress deformation can be appropriately reduced at a heat treatment temperature lower than a heat resistant temperature of the binding agent, and a magnetic permeability μ of the powder core 3 can be increased. Hence, a desired high inductance L can be obtained with a small turn number by using an edgewise coil having a large cross-sectional area of a conductor in each turn as compared to that of a round wire coil. As described above, in the present invention, since the edgewise coil having a large cross-sectional area of a conductor in each turn can be used for the coil 4, a direct current resistance Rdc can be decreased, and the heat generation and the copper loss can be suppressed.

In addition, in this embodiment, the heat treatment temperature T1 after the core formation can be set in a range of approximately 553.15K (280° C.) to 623.15K (350° C.).

In addition, the composition of the Fe-based amorphous alloy according to this embodiment can be measured, for example, by a high frequency inductively coupled plasma mass spectrometry (ICP-MS).

EXAMPLES (Experiment to Obtain Relationship Between Optimum Heat Treatment Temperature and Glass Transition Temperature (Tg))

Fe-based amorphous alloys having respective compositions shown in the following Table 1 were manufactured. By a liquid quenching method, these alloys were each manufactured to have a ribbon shape.

In addition, Sample No. 1 is a comparative example and Sample Nos. 2 to 8 are examples.

It was confirmed by an X-ray diffractometer (XRD) that samples shown Table 1 were all amorphous. In addition, Curie temperature (Tc), the glass transition temperature (Tg), the crystallization starting temperature (Tx), and the melting point (Tm) were measured by a differential scanning calorimeter (DSC) (temperature rise rates for Tc, Tg, and Tx were each 0.67K/sec, and that for Tm was 0.33K/sec).

In addition, the saturation magnetization Is and the saturation mass magnetization σs shown in Table 1 (in appendix) were measured by a vibrating sample magnetometer (VSM).

For an experiment of the core characteristics of Table 1, the annular powder core shown in FIG. 1 was used, and a powder of each Fe-based amorphous alloy shown in Table 1, 3 percent by mass of a resin (acrylate resin), and 0.3 percent by mass of a lubricant (zinc stearate) were mixed together. Subsequently, a core molded body of a toroidal shape having an outside diameter of 20 mm, an inside diameter of 12 mm, and a height of 6.8 mm was formed at a press pressure of 600 MPa and was further processed in a N2 gas atmosphere in which the temperature rise rate was set to 0.67K/sec (40° C./min), the heat treatment temperature was set to 573.15K (300° C.), and a holding time was set to 1 hour.

The "optimum heat treatment temperature" shown in Table 1 indicates an ideal heat treatment temperature at which the core loss (W) of the powder core can be minimized when the heat treatment is performed on the core molded body in which the temperature rise rate is set to 0.67K/sec (40° C./min) and the holding time is set to 1 hour. Among the optimum heat treatment temperatures shown in Table 1, the lowest temperature was 633.15K (360° C.) and was higher than the heat treatment temperature (573.15K) actually applied to the core molded body.

Evaluation of the core loss (W) of the powder core shown in Table 1 was performed at a frequency of 100 kHz and a maximum magnetic flux density of 25 mT using an SY-8217 BH analyzer manufactured by IWATSU TEST INSTRUMENTS CORP. In addition, the magnetic permeability (μ) was measured at a frequency of 100 kHz using an impedance analyzer.

Figure 3:
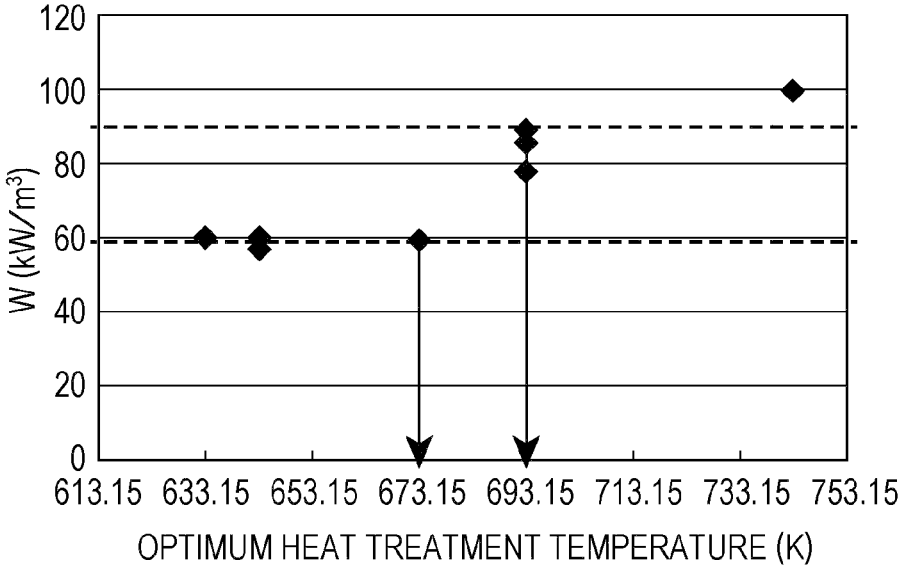
FIG. 3 is a graph showing the relationship between an optimum heat treatment temperature of the powder core and a core loss W.

FIG. 3 is a graph showing the relationship between the core loss (W) and the optimum heat treatment temperature of the powder core shown in Table 1. As shown in FIG. 3, it was found that in order to set the core loss (W) to 90 kW/m3 or less, the optimum heat treatment temperature must be set to 693.15K (420° C.) or less.

Figure 4:
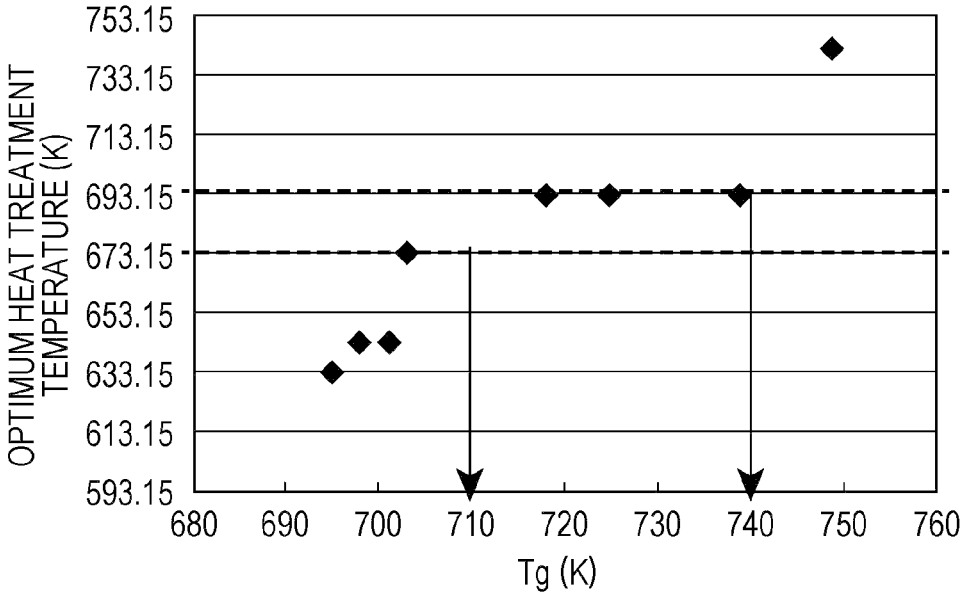
FIG. 4 is a graph showing the relationship between a glass transition temperature (Tg) of an alloy and the optimum heat treatment temperature of the powder core.

In addition, FIG. 4 is a graph showing the relationship between the glass transition temperature (Tg) of the alloy and the optimum heat treatment temperature of the powder core shown in Table 1. As shown in FIG. 4, it was found that in order to set the optimum heat treatment temperature to 693.15K (420° C.) or less, the glass transition temperature (Tg) must be set to 740K (466.85° C.) or less.

In addition, from FIG. 3, it was found that in order to set the core loss (W) to 60 kW/m3 or less, the optimum heat treatment temperature must be set to 673.15K (400° C.) or less. In addition, from FIG. 4, it was found that in order to set the optimum heat treatment temperature to 673.15K (400° C.) or less, the glass transition temperature (Tg) must be set to 710K (436.85° C.) or less.

From the experimental results of Table 1 and FIGS. 3 and 4, an application range of the glass transition temperature (Tg) of this example was set to 740K (466.85° C.) or less. In addition, in this example, a glass transition temperature (Tg) of 710K (436.85° C.) or less was regarded as a preferable application range.

(Experiment of Addition Amount of B and Addition Amount of Si)

Fe-based amorphous alloys having the compositions shown in the following Table 2 (in appendix) were manufactured. By a liquid quenching method, each sample was formed to have a ribbon shape.

In Sample Nos. 9 to 15 (all examples) shown in Table 2, the amount of Fe, the amount of Cr, and the amount of P were fixed, and the amount of C, the amount of B, and the amount of Si were changed. In Sample No. 2 (example), the amount of Fe was set slightly smaller than the amount of Fe of each of Sample Nos. 9 to 15. In Sample Nos. 16 and 17 (comparative examples), although the composition was similar to that of Sample No. 2, a larger amount of Si than that of Sample No. 2 was added.

As shown in Table 2, it was found that when the addition amount z of B was set in a range of 0 to 4.2 at %, and the addition amount t of Si was set in a range of 0 to 3.9 at %, an amorphous material could be formed, and the glass transition temperature (Tg) could be set to 740K (466.85° C.) or less.

In addition, as shown in Table 2, it was found that when the addition amount z of B was set in a range of 0 to 2 at %, the glass transition temperature (Tg) could be more effectively decreased. In addition, it was found that when the addition amount t of Si was set in a range of 0 to 1 at %, the glass transition temperature (Tg) could be more effectively decreased.

In addition, it was found that when (the addition amount z of B+the addition amount t of Si) was set in a range of 0 to 4 at %, the glass transition temperature (Tg) could be more reliably set to 740K (466.85° C.) or less.

In addition, it was found that when the addition amount z of B was set in a range of 0 to 2 at %, the addition amount t of Si was set in a range of 0 to 1 at %, and (the addition amount z of B+the addition amount t of Si) was further set in a range of 0 to 2 at %, the glass transition temperature (Tg) could be set to 710K (436.85° C.) or less.

Alternatively, it was found that when the addition amount z of B was set to 0 to 3 at %, the addition amount t of Si was set to 0 to 2 at %, and (the addition amount z of B and the addition amount t of Si) was further set to 0 to 3 at %, the glass transition temperature (Tg) could be set to 720K (446.85° C.) or less.

In addition, in the examples shown in Table 2, the conversion vitrification temperatures (Tg/Tm) were all 0.540 or more. Furthermore, the saturation mass magnetization σs could be set to 176(×10−6 Wbm/kg) or more, and the saturation magnetization Is could be set to 1.27 or more.

On the other hand, in Sample Nos. 16 and 17, which were the comparative examples, shown in Table 2, the glass transition temperature (Tg) was higher than 740K (466.85° C.).

(Experiment of Addition Amount of Ni)

Fe-based amorphous alloys having the compositions shown in the following Table 3 were manufactured. By a liquid quenching method, the samples were each formed to have a ribbon shape.

TABLE 3

| No. | COMPOSITION | ADDITION AMOUNT OF Ni (at %) | ALLOY CHARACTERISTICS XRD STRUCTURE | Tc (K) | Tg (K) | Tx (K) | ΔTx (K) | Tm (K) | Tg/Tm | Tx/Tm |
|---|---|---|---|---|---|---|---|---|---|---|
| 18 | $Fe_{75.9}Cr_4P_{10.8}C_{6.3}B_2Si_1$ | 0 | AMORPHOUS | 498 | 713 | 731 | 18 | 1266 | 0.563 | 0.577 |
| 19 | $Fe_{74.9}Ni_1Cr_4P_{10.8}C_{6.3}B_2Si_1$ | 1 | AMORPHOUS | 502 | 713 | 729 | 16 | 1264 | 0.564 | 0.577 |
| 20 | $Fe_{73.9}Ni_2Cr_4P_{10.8}C_{6.3}B_2Si_1$ | 2 | AMORPHOUS | 506 | 709 | 728 | 19 | 1262 | 0.562 | 0.577 |
| 21 | $Fe_{72.9}Ni_3Cr_4P_{10.8}C_{6.3}B_2Si_1$ | 3 | AMORPHOUS | 511 | 706 | 727 | 21 | 1260 | 0.560 | 0.577 |
| 22 | $Fe_{71.9}Ni_4Cr_4P_{10.8}C_{6.3}B_2Si_1$ | 4 | AMORPHOUS | 514 | 700 | 724 | 24 | 1258 | 0.556 | 0.576 |
| 23 | $Fe_{69.9}Ni_6Cr_4P_{10.8}C_{6.3}B_2Si_1$ | 6 | AMORPHOUS | 520 | 697 | 722 | 25 | 1253 | 0.556 | 0.576 |
| 24 | $Fe_{67.9}Ni_8Cr_4P_{10.8}C_{6.3}B_2Si_1$ | 8 | AMORPHOUS | 521 | 694 | 721 | 27 | 1270 | 0.546 | 0.568 |
| 25 | $Fe_{65.9}Ni_{10}Cr_4P_{10.8}C_{6.3}B_2Si_1$ | 10 | AMORPHOUS | 525 | 689 | 717 | 28 | 1273 | 0.541 | 0.563 |

In Sample Nos. 18 to 25 (all examples) shown in Table 3, the addition amounts of Cr, P, C, B, and Si were fixed, and the amount of Fe and the amount of Ni were changed. As shown in Table 3, it was found that even if the addition amount a of Ni was increased to 10 at %, an amorphous material could be obtained. In addition, in all the samples, the glass transition temperature (Tg) was 720K (446.85° C.) or less, and the conversion vitrification temperature (Tg/Tm) was 0.54 or more.

Figure 5:
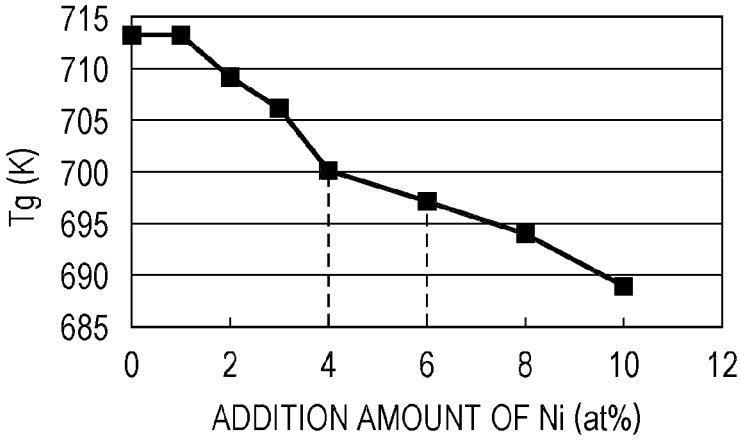
FIG. 5 is a graph showing the relationship between an addition amount of Ni of the alloy and the glass transition temperature (Tg)
Figure 6:
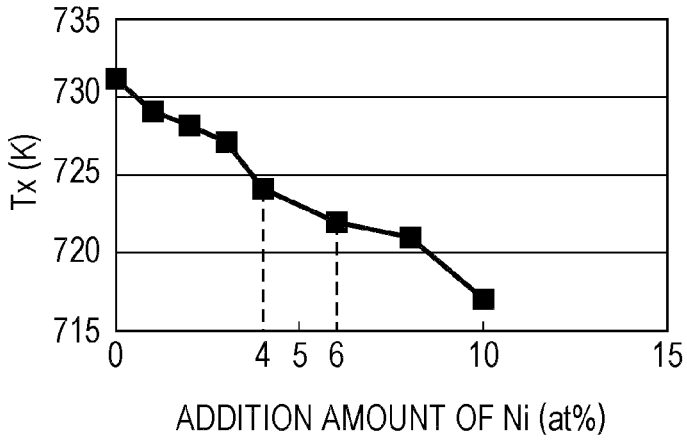
FIG. 6 is a graph showing the relationship between the addition amount of Ni of the alloy and a crystallization starting temperature (Tx)
Figure 7:
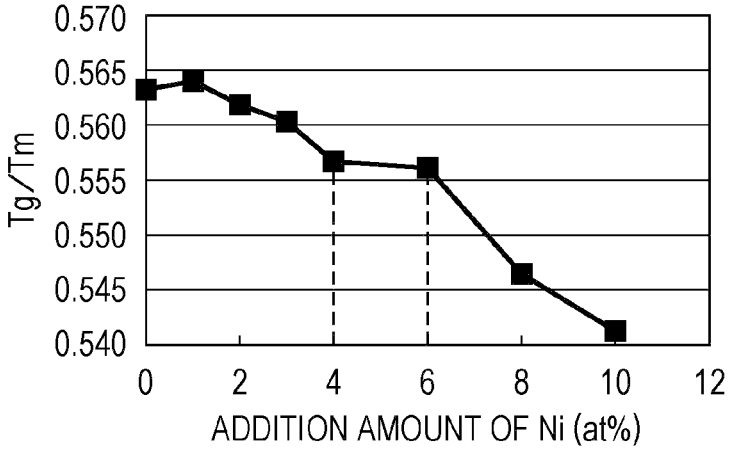
FIG. 7 is a graph showing the relationship between the addition amount of Ni of the alloy and a conversion vitrification temperature (Tg/Tm)
Figure 8:
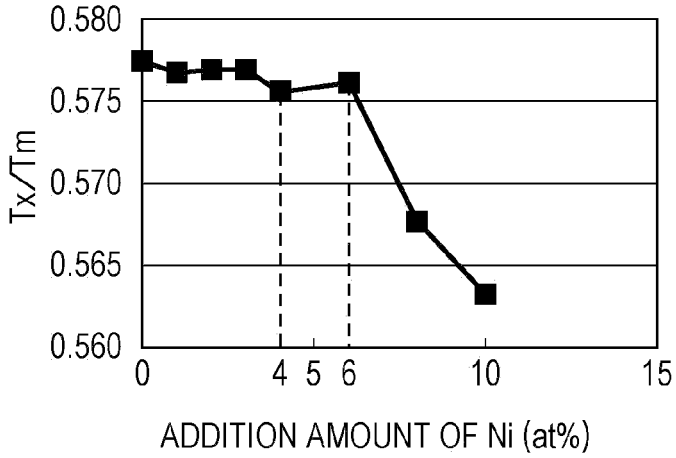
FIG. 8 is a graph showing the relationship between the addition amount of Ni of the alloy and Tx/Tm.

FIG. 5 is a graph showing the relationship between the addition amount of Ni of the alloy and the glass transition temperature (Tg), FIG. 6 is a graph showing the relationship between the addition amount of Ni of the alloy and the crystallization starting temperature (Tx), FIG. 7 is a graph showing the relationship between the addition amount of Ni of the alloy and the conversion vitrification temperature (Tg/Tm), and FIG. 8 is a graph showing the relationship between the addition amount of Ni of the alloy and Tx/Tm.

As shown in FIGS. 5 and 6, it was found that when the addition amount a of Ni was increased, the glass transition temperature (Tg) and the crystallization starting temperature (Tx) were gradually decreased.

In addition, as shown in FIGS. 7 and 8, it was found that even if the addition amount a of Ni was increased to approximately 6 at %, although high conversion vitrification temperature (Tg/Tm) and Tx/Tm could be maintained, when the addition amount a of Ni was increased to more than 6 at %, the conversion vitrification temperature (Tg/Tm) and Tx/Tm were rapidly decreased.

In this example, as the glass transition temperature (Tg) was decreased, it was necessary to improve the amorphous formability by increasing the conversion vitrification temperature (Tg/Tm), and hence, the addition amount a of Ni was set in a range of 0 to 10 at % and preferably set in a range of 0 to 6 at %.

In addition, it was found that when the addition amount a of Ni was set in a range of 4 to 6 at %, the glass transition temperature (Tg) could be decreased, and in addition, high conversion vitrification temperature (Tg/Tm) and Tx/Tm could also be stably obtained.

(Experiment of Addition Amount of Sn)

Fe-based amorphous alloys having the compositions shown in the following Table 4 were manufactured. By a liquid quenching method, the samples were each formed to have a ribbon shape.

In Sample Nos. 26 to 29 shown in Table 4 (in appendix), the addition amounts of Cr, P, C, B, and Si were fixed, and the amount of Fe and the amount of Sn were changed. It was found that even if the amount of Sn was increased to 3 at %, an amorphous material could be obtained.

However, as shown in Table 4, it was found that when the addition amount b of Sn was increased, an oxygen concentration of the alloy powder was increased, and the corrosion resistance was degraded. When the corrosion resistance is inferior, in order to improve the corrosion resistance, Cr is to be added; however, the saturation magnetization Is and the saturation mass magnetization σs are to be unfavorably degraded. Hence, it was found that the addition amount b must be decreased to the necessary minimum.

Figure 9:
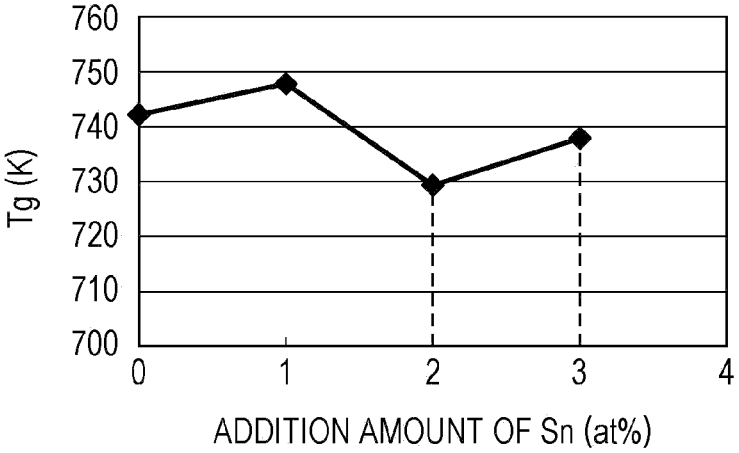
FIG. 9 is a graph showing the relationship between an addition amount of Sn of the alloy and the glass transition temperature (Tg)
Figure 10:
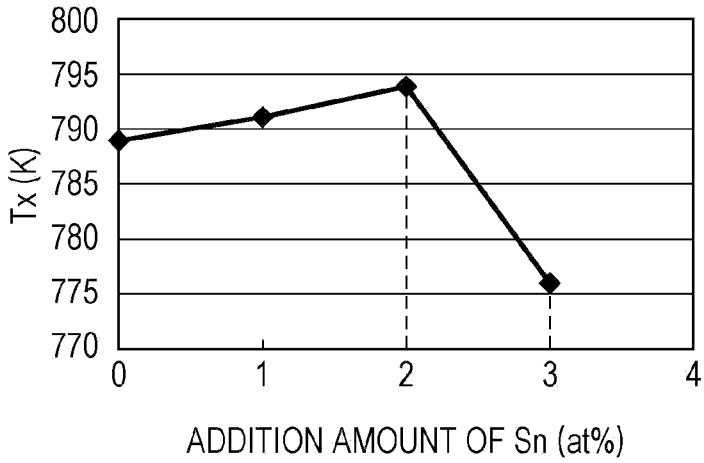
FIG. 10 is a graph showing the relationship between the addition amount of Sn of the alloy and the crystallization starting temperature (Tx)
Figure 11:
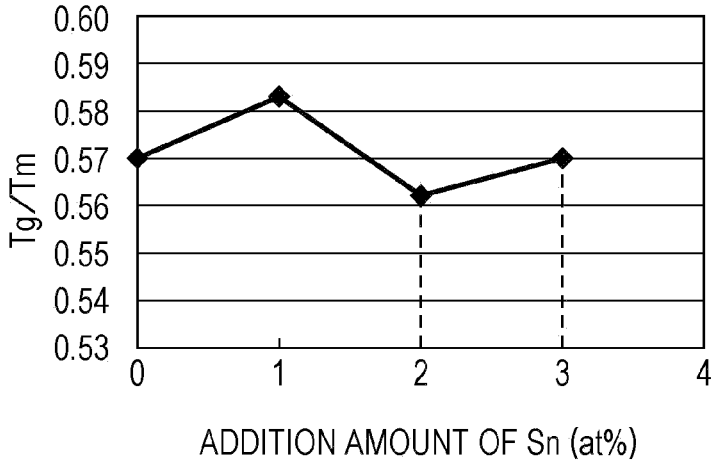
FIG. 11 is a graph showing the relationship between the addition amount of Sn of the alloy and the conversion vitrification temperature (Tg/Tm)
Figure 12:
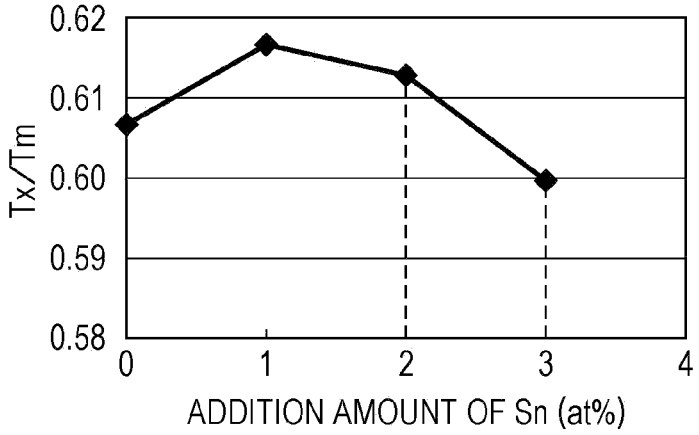
FIG. 12 is a graph showing the relationship between the addition amount of Sn of the alloy and Tx/Tm.

FIG. 9 is a graph showing the relationship between the addition amount of Sn of the alloy and the glass transition temperature (Tg), FIG. 10 is a graph showing the relationship between the addition amount of Sn of the alloy and the crystallization starting temperature (Tx), FIG. 11 is a graph showing the relationship between the addition amount of Sn of the alloy and the conversion vitrification temperature (Tg/Tm), and FIG. 12 is a graph showing the relationship between the addition amount of Sn of the alloy and Tx/Tm.

As shown in FIG. 9, it was observed that when the addition amount b of Sn was increased, the glass transition temperature (Tg) tended to decrease.

In addition, as shown in FIG. 12, it was found that when the addition amount b of Sn was set to 3 at %, Tx/Tm was decreased, and the amorphous formability was degraded.

Therefore, in this example, in order to suppress the degradation in corrosion resistant and to maintain high amorphous formability, the addition amount b of Sn was set in a range of 0 to 3 at % and preferably set in a range of 0 to 2 at %.

If the addition amount b of Sn is set to 2 to 3 at %, although Tx/Tm is decreased as described above, the conversion vitrification temperature (Tg/Tm) can be increased.

As shown in each table, except for Sample No. 7, the Fe-based amorphous alloys each contain neither Ni nor Si or each contain one of Ni and Sn. On the other hand, in Sample No. 7 containing both Ni and Sn, the magnetization was slightly small as compared to that of the other samples; hence, it was found that when neither Ni nor Sn were contained, or one of Ni and Sn was contained, the magnetization could be increased.

(Experiment of Addition Amount of P and Addition Amount of C)

Fe-based amorphous alloys having the compositions shown in the following Table 5 were manufactured. By a liquid quenching method, the samples were each formed to have a ribbon shape.

In Sample Nos. 9, 10, 12, 14, 15, and 30 to 33 (all examples) shown in Table 5, the addition amounts of Fe and Cr were fixed, and the addition amounts of P, C, B, and Si were changed.

As shown in Table 5 (in appendix), it was found that when the addition amount x of P was adjusted in a range of 6.8 to 10.8 at %, and the addition amount y of C was adjusted in a range of 2.2 to 9.8 at %, an amorphous material could be obtained. In addition, in each example, the glass transition temperature (Tg) could be set to 740K (466.85° C.) or less, and the conversion vitrification temperature (Tg/Tm) could be set to 0.52 or more.

Figure 13:
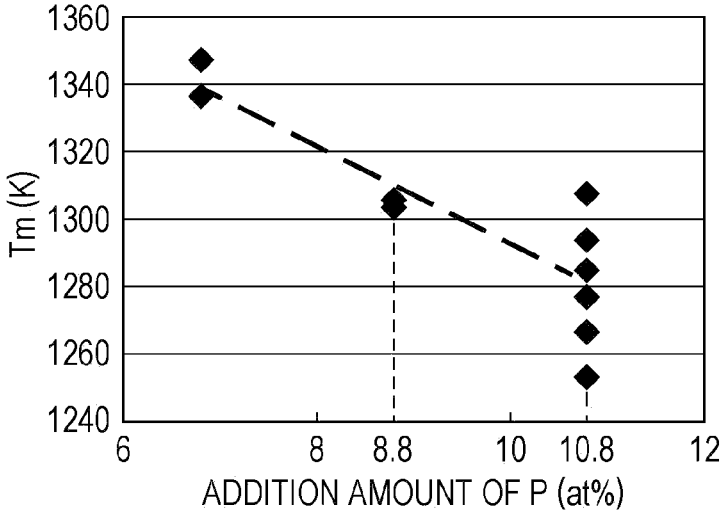
FIG. 13 is a graph showing the relationship between an addition amount of P of the alloy and a melting point (Tm)
Figure 14:
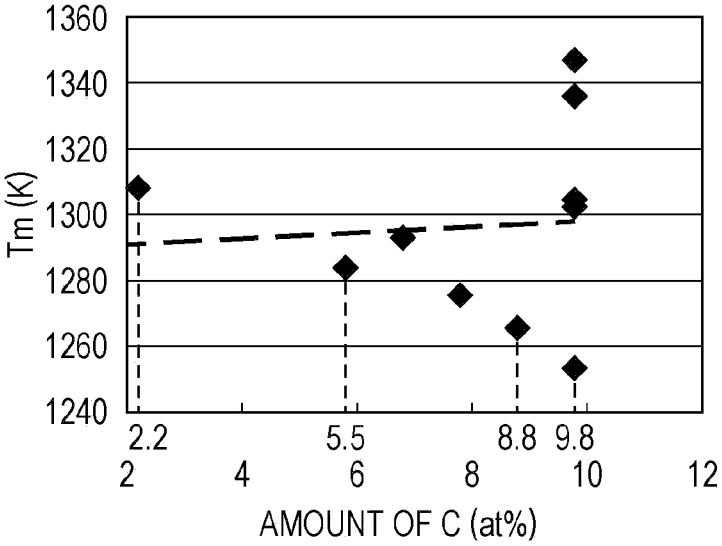
FIG. 14 is a graph showing the relationship between an addition amount of C of the alloy and the melting point (Tm)

FIG. 13 is a graph showing the relationship between the addition amount x of P of the alloy and the melting point (Tm), and FIG. 14 is a graph showing the relationship between the addition amount y of C of the alloy and the melting point (Tm).

In this example, although the glass transition temperature (Tg) could be set to 740K (466.85° C.) or less and preferably set to 710K (436.85° C.) or less, since the glass transition temperature (Tg) was decreased, the melting point (Tm) must be decreased in order to improve the amorphous formability represented by Tg/Tm. In addition, as shown in FIGS. 13 and 14, it is believed that the melting point (Tm) depends on the amount of P as compared to that on the amount of C.

In particular, it was found that when the addition amount x of P was set in a range of 8.8 to 10.8 at %, the melting point (Tm) could be effectively decreased, and hence the conversion vitrification temperature (Tg/Tm) could be increased.

In addition, it was found that when the addition amount y of C was set in a range of 5.8 to 8.8 at %, the melting point (Tm) could be easily decreased, and hence the conversion vitrification temperature (Tg/Tm) could be increased.

In addition, in each example shown in Table 5, the saturation mass magnetization σs could be set to 176×10−6 Wbm/kg or more, and the saturation magnetization Is could be set to 1.27T or more.

In addition, in all the examples, the addition amount t of Si/(the addition amount t of Si+the addition amount x of P) was in a range of 0 to 0.36. In addition, the addition amount t of Si/(the addition amount t of Si+the addition amount x of P) was preferably set in a range of 0 to 0.25. For example, in Sample No. 2 shown in Table 2, the addition amount t of Si/(the addition amount t of Si+the addition amount x of P) was more than 0.25. On the other hand, in each example shown in Table 5, although the addition amount t of Si/(the addition amount t of Si+the addition amount x of P) was lower than 0.25, it was found that when the addition amount t of Si/(the addition amount t of Si+the addition amount x of P) was set low, the glass transition temperature (Tg) could be effectively decreased, and in addition, the conversion vitrification temperature (Tg/Tm) could be maintained at a high value of 0.52 or more (preferably 0.54 or more).

In addition, the lower limit of the addition amount t of Si/(the addition amount t of Si+the addition amount x of P) in the case in which Si is added is preferably 0.08.

Even if Si is added as described above, when the ratio of the amount of Si to the amount of P is decreased, the glass transition temperature (Tg) can be effectively decreased, and the conversion vitrification temperature (Tg/Tm) can be increased.

(Experiment of Addition Amount of Cr)

Fe-based amorphous alloys having the compositions shown in the following Table 6 were manufactured. By a liquid quenching method, the samples were each formed to have a ribbon shape.

In Samples shown in Table 6 (in appendix), the addition amounts of Ni, P, C, B, and Si were fixed, and the addition amounts of Fe and Cr were changed. As shown in Table 6, it was found that when the addition amount of Cr was increased, the oxygen concentration of the alloy powder was gradually decreased, and the corrosion resistance was improved.

Figure 15:
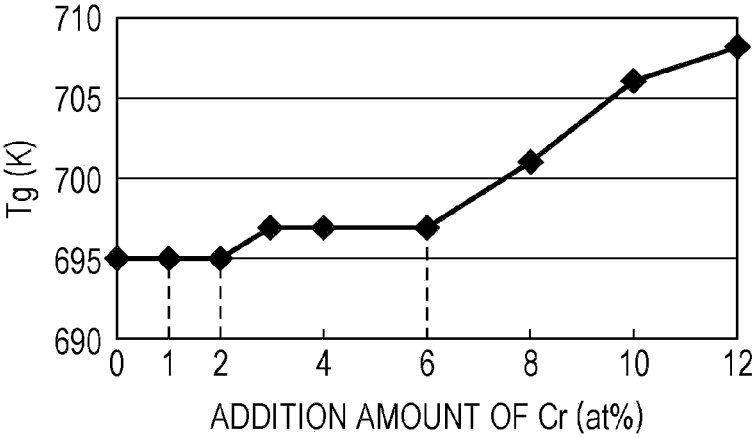
FIG. 15 is a graph showing the relationship between an addition amount of Cr of the alloy and the glass transition temperature (Tg)
Figure 16:
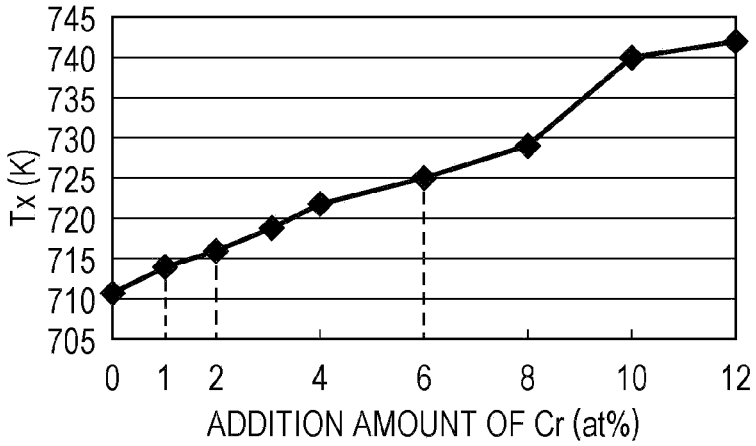
FIG. 16 is a graph showing the relationship between the addition amount of Cr of the alloy and the crystallization starting temperature (Tx)
Figure 17:
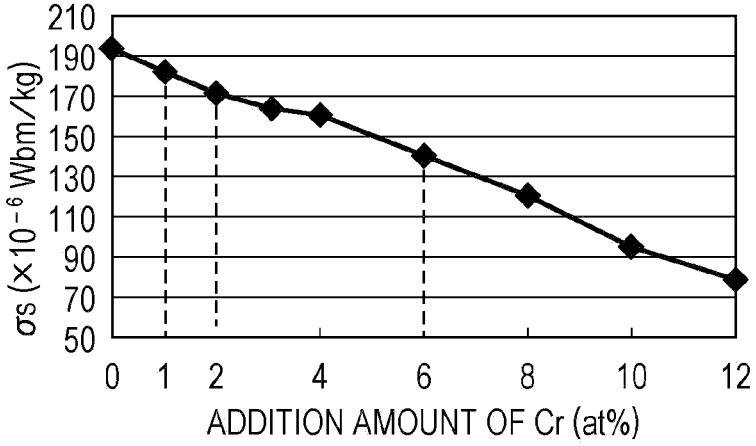
FIG. 17 is a graph showing the relationship between the addition amount of Cr of the alloy and a saturation magnetic flux density Is.

FIG. 15 is a graph showing the relationship between the addition amount of Cr of the alloy and the glass transition temperature (Tg), FIG. 16 is a graph showing the relationship between the addition amount of Cr of the alloy and the crystallization starting temperature (Tx), and FIG. 17 is a graph showing the relationship between the addition amount of Cr of the alloy and the saturation magnetization Is.

As shown in FIG. 15, it was found that when the addition amount of Cr was increased, the glass transition temperature (Tg) was gradually increased. In addition, as shown in Table 6 and FIG. 17, it was found that by increasing the addition amount of Cr, the saturation mass magnetization σs and the saturation magnetization Is were gradually decreased.

The addition amount c of Cr was set in a range of 0 to 6 at % so that the glass transition temperature (Tg) was low, the saturation mass magnetization σs was 140×10-6 Wbm/kg or more, and the saturation magnetization Is was 1T or more as shown in FIG. 15 and Table 6. In addition, a preferable addition amount c of Cr was set in a range of 0 to 2 at %. As shown in FIG. 15, when the addition amount c of Cr was set in a range of 0 to 2 at %, the glass transition temperature (Tg) could be set to a low value regardless of the amount of Cr.

Furthermore, it was found that when the addition amount c of Cr was set in a range of 1 to 2 at %, the corrosion resistance could be improved, a low glass transition temperature (Tg) could be stably obtained, and higher magnetization could be maintained.

In addition, in all the examples of Table 6, the glass transition temperature (Tg) could be set to 700K (426.85° C.) or less, and the conversion vitrification temperature (Tg/Tm) could be set to 0.55 or more.

(Experiment of Core Characteristics of Coil Encapsulated Powder Core Formed Using Powder of Fe-Based Amorphous Alloy of Each of Sample Nos. 3, 5, and 6)

Sample Nos. 3, 5, and 6 shown in Table 7 (in appendix) are the same as those shown in Table 1. That is, the powder of each Fe-based amorphous alloy was formed by a water atomizing method, and each powder core was further formed under manufacturing conditions of the annular powder core of FIG. 1 described in the explanation for Table 1.

Powder characteristics and core characteristics (same as those shown in Table 1) of Sample Nos. 3, 5, and 6 are shown in the following Table 7.

The grain size shown in Table 7 was measured using a micro track particle size distribution measuring device, MT300EX, manufactured by Nikkiso Co., Ltd.

Next, the inductance (L), the core loss (W), and the power supply efficiency (η) were each measured using a coil encapsulated powder core formed using the Fe-based amorphous alloy powder of each of Sample Nos. 3, 5, and 6 in which the coil 4 as shown in FIGS. 2A and 2B was encapsulated in the powder core 3.

The inductance (L) was measured using an LRC meter. In addition, the power supply efficiency (η) was measured by mounting the coil encapsulated powder core in a power supply. In addition, the measuring frequency of the power supply efficiency (η) was set to 300 kHz. In addition, the coil encapsulated powder core using each of the alloy powders of Sample Nos. 3, 5, and 6 were formed as described below. After the alloy powder of each sample, 3 percent by mass of a resin (acrylate resin), and 0.3 percent by mass of a lubricant (zinc stearate) were mixed together, in the state in which a coil having 2.5 turns was encapsulated in the above mixture of the alloy powder, the resin, and the like, a core molded body having a size of 6.5 mm square and a height of 3.3 mm was formed at a press pressure of 600 MPa and was further processed in a N2 gas atmosphere in which the temperature rise rate was set to 0.03K/sec (2° C./min), the heat treatment temperature was set to 623.15K (350° C.), and the holding time was set to 1 hour.

Figure 18:
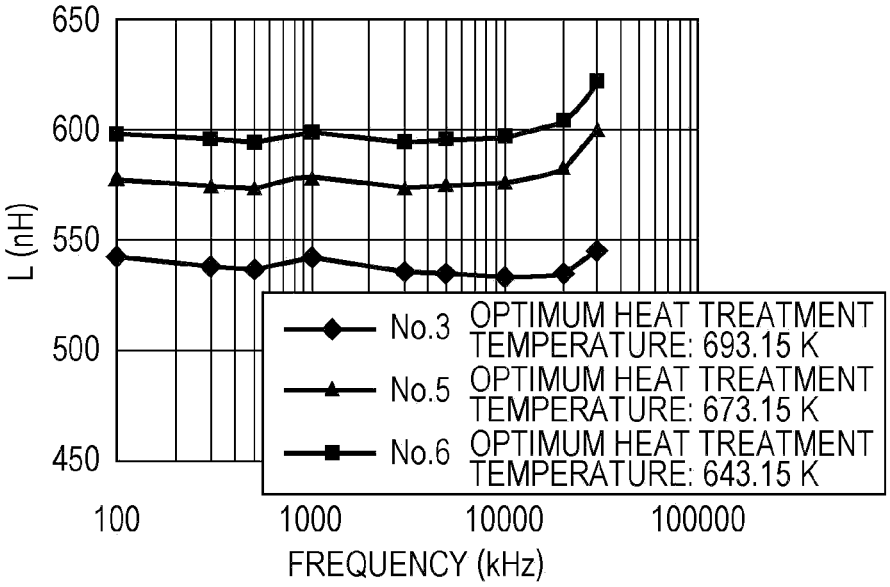
FIG. 18 is a graph showing the relationship between the frequency and an inductance L of a coil encapsulated powder core formed using an Fe-based amorphous alloy powder of each of Samples 3, 5, and 6.
Figure 19:
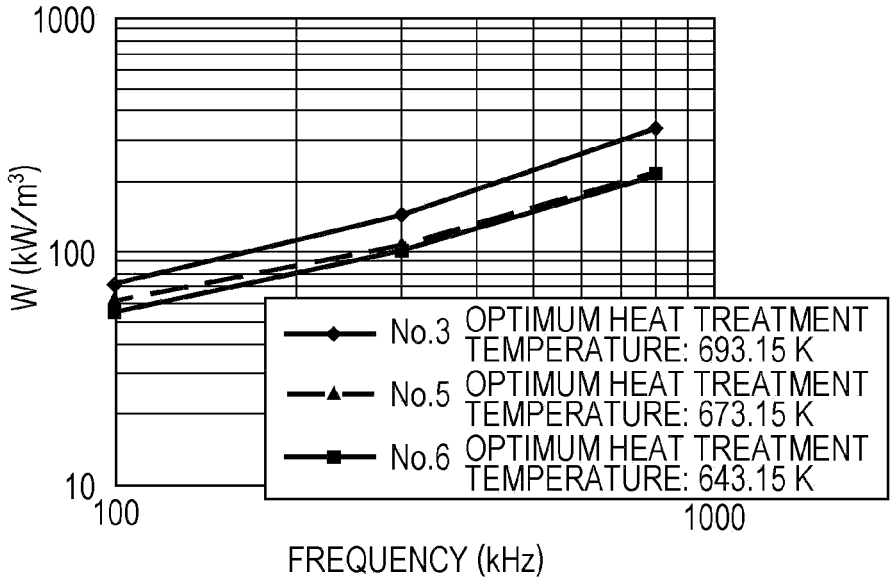
FIG. 19 is a graph showing the relationship between the frequency and a core loss W of the coil encapsulated powder core formed using the Fe-based amorphous alloy powder of each of Samples 3, 5, and 6.

FIG. 18 is a graph showing the relationship between the frequency and the inductance of each coil encapsulated powder core similar to that shown in FIGS. 2A and 2B, FIG. 19 is a graph showing the relationship between the frequency and the core loss W (the maximum magnetic flux density was fixed at 25 mT) of each coil encapsulated powder core described above, and FIG. 20 is a graph showing the relationship between an output current and the power conversion efficiency (η).

As shown in FIG. 18, it was found that the inductance (L) could be increased as the optimum heat treatment temperature of the coil encapsulated powder core formed using the Fe-based amorphous alloy powder was decreased.

In addition, as shown in FIG. 19, it was found that the core loss (W) could be reduced as the optimum heat treatment temperature of the coil encapsulated powder core formed using the Fe-based amorphous alloy powder was decreased.

Figure 20:
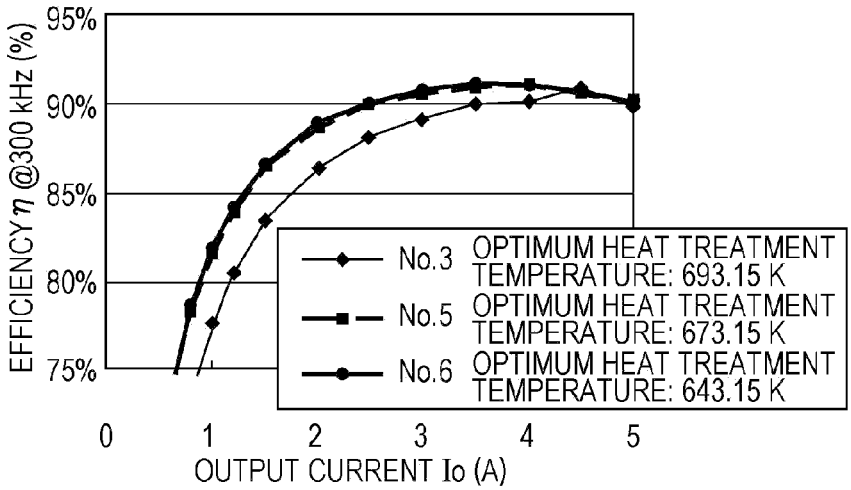
FIG. 20 is a graph showing the relationship between an output current and power supply efficiency (η) (measuring frequency: 300 kHz) when the coil encapsulated powder core formed using the Fe-based amorphous alloy powder of each of Samples 3, 5, and 6 is mounted in the same power supply.

Furthermore, as shown in FIG. 20, it was found that the power supply efficiency (η) could be increased as the optimum heat treatment temperature of the coil encapsulated powder core formed using the Fe-based amorphous alloy powder was decreased.

It was found that in particular, when the optimum heat treatment temperature of the coil encapsulated powder core was 673.15K (400° C.) or less, the core loss (W) could be effectively reduced, and the power supply efficiency (η) could be effectively increased.

(Experiment of Core Characteristics of Fe-Based Amorphous Alloy Powder of this Example and Related Product (Coil Encapsulated Powder Core))

The measuring frequency was set to 300 kHz, and manufacturing conditions of each coil encapsulated powder core were adjusted so as to obtain an inductance of approximately 0.5 μH.

In the experiment, the coil encapsulated powder core was formed using the powder of the Fe-based amorphous alloy of each of Sample Nos. 5 and 6 as the example.

The coil encapsulated powder core (inductance L: 0.49 μH) using the sample of Sample No. 5 was formed as described below. After the Fe-based amorphous alloy powder, 3 percent by mass of a resin (acrylate resin), and 0.3 percent by mass of a lubricant (zinc stearate) were mixed together, in the state in which a coil having 2.5 turns was encapsulated in the above mixture, a core molded body having a size of 6.5 mm square and a height of 2.7 mm was formed at a press pressure of 600 MPa and was further processed in a N2 gas atmosphere in which the heat treatment temperature was set to 350° C. (temperature rise rate: 2° C./min)).

In addition, the coil encapsulated powder core (inductance L: 0.5 μH) using the sample of Sample No. 6 was formed as described below. After the Fe-based amorphous alloy powder, 3 percent by mass of a resin (acrylate resin), and 0.3 percent by mass of a lubricant (zinc stearate) were mixed together, in the state in which a coil having 2.5 turns was encapsulated in the above mixture, a core molded body having a size of 6.5 mm square and a height of 2.7 mm was formed at a press pressure of 600 MPa and was further processed in a N2 gas atmosphere in which the heat treatment temperature was set to 320° C. (temperature rise rate: 2° C./min)).

In addition, a commercialized product 1 was a coil encapsulated powder core in which a magnetic powder was formed of a carbonyl Fe powder, a commercialized product 2 was a coil encapsulated powder core formed of an Fe-based amorphous alloy powder, and a commercialized product 3 was a coil encapsulated powder core in which a magnetic powder was formed of a FeCrSi alloy. In addition, the inductance of each of the above products was 0.5 μH.

Figure 21:
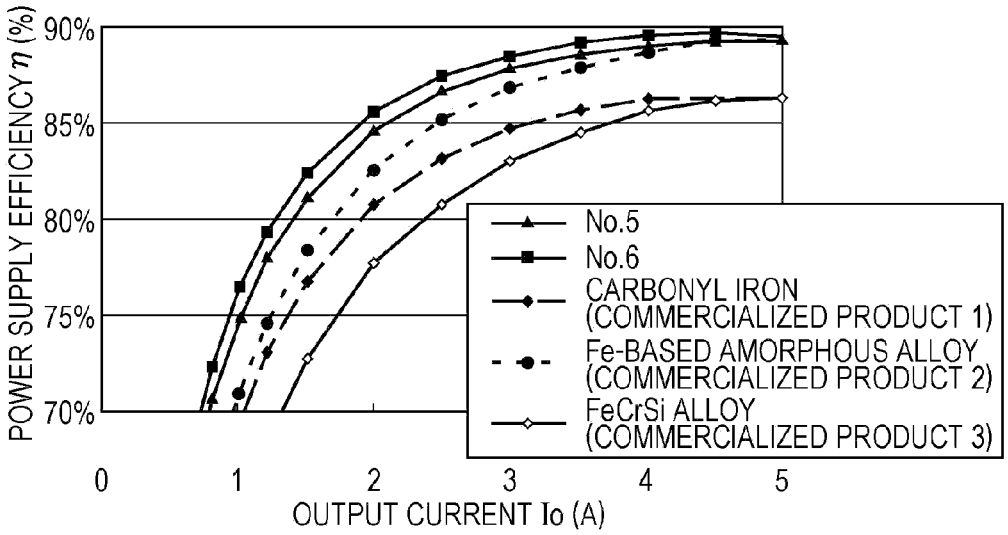
FIG. 21 is a graph showing the relationship between the output current and the power supply efficiency (η) (measuring frequency: 300 kHz) when the coil encapsulated powder core (corresponding to an inductance of 0.5 μH) formed using the Fe-based amorphous alloy powder of each of Samples 3, 5, and 6 and a commercialized product are mounted in the same power supply.
Figure 22:
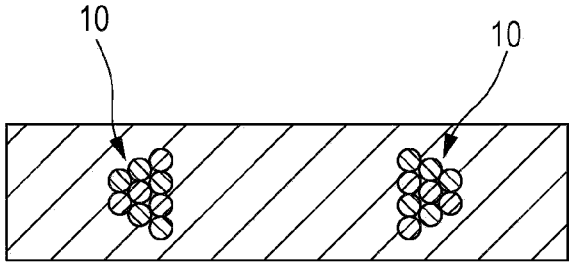
FIG. 22 is a longitudinal cross-sectional view of a coil encapsulated powder core (comparative example) formed using an Fe-based crystalline alloy powder used in an experiment.

FIG. 21 shows the relationship between the output current and the power supply efficiency (η) of each sample. As shown in FIG. 21, it was found that a high power supply efficiency (η) compared to that of each commercialized product could be obtained in this example.

(Experiment of Coil Encapsulated Powder Cores Formed Using Fe-Based Amorphous Alloy Powder of this Example and Fe-Based Crystalline Alloy Powder of Comparative Example)

As the example, the Fe-based amorphous alloy powder of Sample No. 6, 3 percent by mass of a resin (acrylate resin), and 0.3 percent by mass of a lubricant (zinc stearate) were mixed together, and in the state in which an edgewise coil shown in FIG. 2B was encapsulated in the above mixture, a core molded body having a size of 6.5 mm square and a height of 2.7 mm was formed at a press pressure of 600 MPa and was further processed in a N2 gas atmosphere in which the heat treatment temperature was set to 320° C. (temperature rise rate: 2° C./min)).

In addition, as the comparative example, a commercialized coil encapsulated powder core using an Fe-based crystalline alloy powder was prepared.

In the experiment, as the example, a coil encapsulated powder core (3.3 μH-corresponding product) having a turn number of 7 and an inductance of 3.31 μH (at 100 kHz) was formed using an edgewise coil having a conductor width dimension of 0.87 mm and a thickness of 0.16 mm.

In addition, in the experiment, as the example, a coil encapsulated powder core (4.7 μH-corresponding product) having a turn number of 10 and an inductance of 4.84 μH (at 100 kHz) was formed using an edgewise coil having a conductor width dimension of 0.87 mm and a thickness of 0.16 mm.

In addition, in the experiment, as a coil encapsulated powder core of the comparative example, a coil encapsulated powder core (3.3 μH-corresponding product) having a turn number of 10.5 and an inductance of 3.48 μH (at 100 kHz) was formed using a round wire coil having a conductor diameter of 0.373 mm.

In addition, in the experiment, as a coil encapsulated powder core of the comparative example, a coil encapsulated powder core (4.7 μH-corresponding product) having a turn number of 12.5 and an inductance of 4.4 μH (at 100 kHz) was formed using a round wire coil having a conductor diameter of 0.352 mm.

Although the coil encapsulated powder core of the example used an edgewise coil, and the coil encapsulated powder core of the comparative example used a round wire coil, the reason for this was that the magnetic permeability μ of the Fe-based amorphous alloy powder of the example was high, such as 25.9 (see Table 1), and on the other hand, the magnetic permeability of the Fe-based crystalline alloy powder of the comparative example was low, such as 19.2.

When it is intended to increase the value of the inductance L, the turn number of the coil must be increased so as to correspond to the above increase; however, when the magnetic permeability μ is low as that in the comparative example, the turn number must be further increased as compared to that of the example.

When the cross-sectional area of the conductor in each turn of the coil is calculated using the dimensions of the edgewise coil and the round wire coil, the area of the edgewise coil used for the example is larger than that of the round wire coil. Accordingly, the edgewise coil used for this experiment cannot increase the turn number in the powder core as compared to that of the round wire coil. Alternatively, when the turn number of the edgewise coil is increased, since the thickness of the powder core located at each of the upper and the lower sides of the coil is remarkably decreased, the effect of increasing the inductance L obtained by the increased of the turn number is decreased, and as a result, a predetermined high inductance L cannot be obtained.

Accordingly, in the comparative example, the turn number was increased using the round wire coil which could decrease the cross-sectional area of the conductor in each turn as compared to that of the edgewise coil, and adjustment was performed so as to obtain a predetermined high inductance L.

On the other hand, in the example, since the magnetic permeability μ of the powder core was high, a predetermined high inductance could be obtained by decreasing the turn number as compared to that of the comparative example; hence, in the example, the edgewise coil having a larger cross-sectional area of the conductor in each turn than that of the round wire coil could be used. Of course, also in the coil encapsulated powder core using the Fe-based amorphous alloy powder of the example, when a targeted inductance is further increased by using an edgewise coil, since the turn number is increased, and the thickness of the powder core at each of the upper and the lower sides of the coil is decreased, a sufficient effect of increasing the inductance cannot be expected; however, in this example, the edgewise coil can be used for adjustment of the inductance in a wide range as compared to that of the comparative example.

In addition, in the experiment, the direct current resistance Rdc of the coil of each of the 3.3 μH-corresponding product and the 4.7 μH-corresponding product of the example and that of each of the 3.3 μH-corresponding product and the 4.7 μH-corresponding product of the comparative example were measured. The experimental results are shown in Table 8.

TABLE 8

| | EXAMPLE EDGEWISE COIL | | COMPARATIVE EXAMPLE ROUND WIRE COIL | |
|---|---|---|---|---|
| | L (100 kHz) (μH) | Rdc (mΩ) | L (100 kHz) (μH) | Rdc (mΩ) |
| 3.3 μH-CORRESPONDING PRODUCT | 3.31 | 17.12 | 3.48 | 23.13 |
| 4.7 μH-CORRESPONDING PRODUCT | 4.84 | 22.78 | 4.4 | 31.83 |

As described above, in the comparative example, although the round wire coil was used, as shown in Table 8, in the comparative example in which the round wire coil was used, the direct current resistance Rdc was increased. Hence, in the coil encapsulated powder core of the comparative example, the loss including the heat generation and the copper loss cannot be appropriately suppressed.

On the other hand, in the example, since the magnetic permeability μ of the Fe-based amorphous alloy powder can be increased as described above, by using the edgewise coil which has a large cross-sectional area as compared to that of the round wire coil used in this experiment, a desirably high inductance L can be obtained with a small turn number. In the coil encapsulated powder core of this example as described above, since the edgewise coil having a large cross-sectional area can be used as the coil, as shown in Table 8, compared to the comparative example, the direct current resistance Rdc can be decreased, and the loss including the heat generation and the copper loss can be appropriately suppressed.

Next, the power supply efficiency (η) to the output current was measured using the coil encapsulated powder core (4.7 μH-corresponding product) of the example and the coil encapsulated powder core (4.7 μH-corresponding product) of the comparative example shown in Table 8.

Figure 23A:
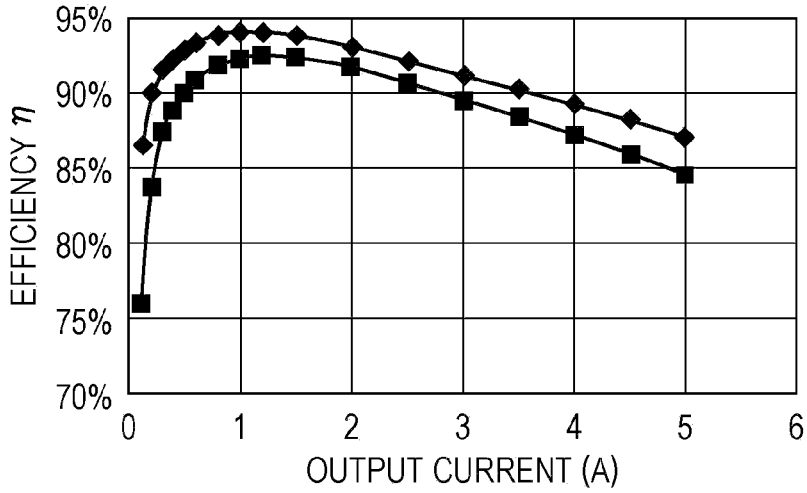
FIG. 23A is a graph showing the relationship between the output current and the power supply efficiency (η) (measuring frequency: 300 kHz) when the coil encapsulated powder core (example: corresponding to an inductance of 4.7 μH) formed using the Fe-based amorphous alloy powder of Sample 6 and a coil encapsulated powder core (comparative example: corresponding to an inductance of 4.7 μH) formed using an Fe-based crystalline alloy powder are mounted in the same power supply.
Figure 23B:
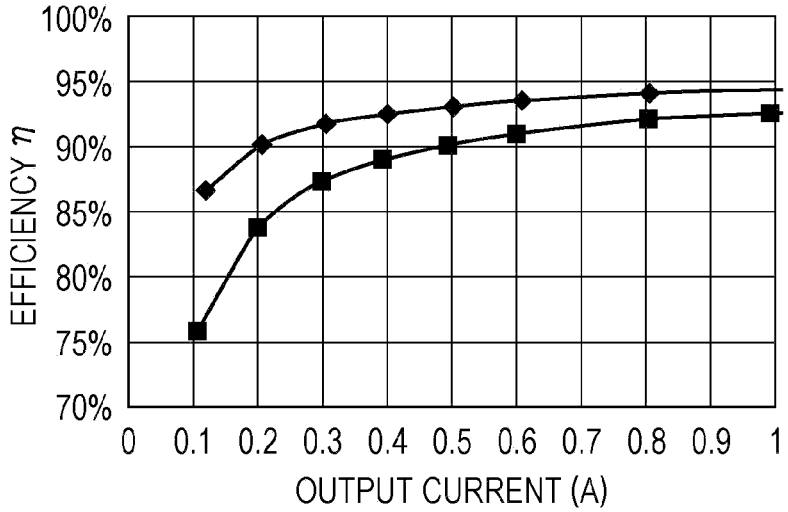
FIG. 23B is an enlarged graph showing the output current of FIG. 23A in a range of 0.1 to 1 A.
Figure 24A:
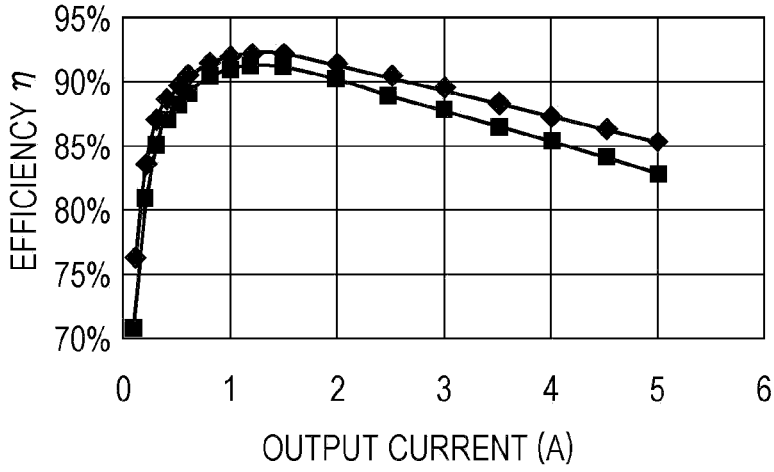
FIG. 24A is a graph showing the relationship between the output current and the power supply efficiency (η) (measuring frequency: 500 kHz) when the coil encapsulated powder core (example: corresponding to an inductance of 4.7 μH) formed using the Fe-based amorphous alloy powder of Sample 6 and the coil encapsulated powder core (comparative example: corresponding to an inductance of 4.7 μH) formed using the Fe-based crystalline alloy powder are mounted in the same power supply.
Figure 24B:
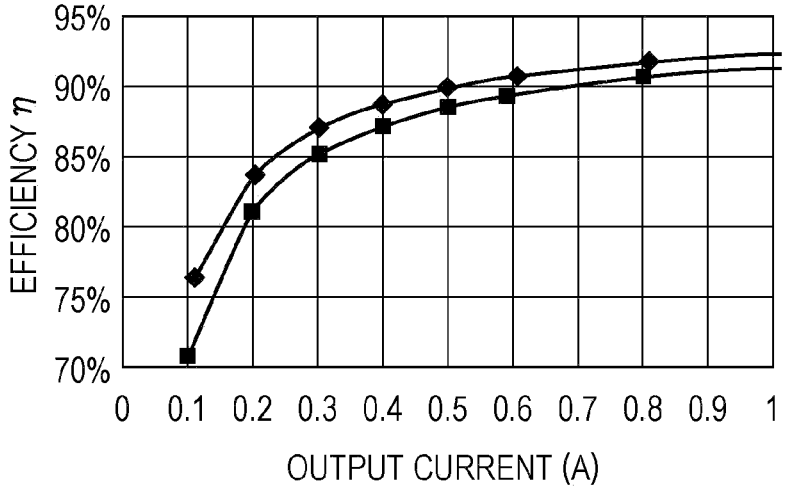
FIG. 24B is an enlarged graph showing the output current of FIG. 24A in a range of 0.1 to 1 A.

FIGS. 23A and 23B each show the experimental result of the relationship between the output current and the power supply efficiency (η) of the 4.7 μH-corresponding product of each of the example and the comparative example obtained when the measuring frequency was set to 300 kHz. FIGS. 24A and 24B each show the experimental result showing the relationship between the output current and the power supply efficiency (η) of the 4.7 μH-corresponding product of each of the example and the comparative example obtained when the measuring frequency was set to 500 kHz. In addition, when the output current is in a range of 0.1 to 1 A, since the graph of the example and that of the comparative example are shown as if being overlapped with each other, particularly, in FIG. 24A, in each of FIGS. 23B and 24B, the experiment result of the power supply efficiency (II) is enlarged in an output current range of 0.1 to 1 A.

As shown in FIGS. 23A, 23B, 24A, and 24B, it was found that in this example, a high power supply efficiency (η) as compared to that of the comparative example could be obtained.

TABLE 1

| | No. | COMPOSITION | ALLOY CHARACTERISTICS | | | | | |
|---|---|---|---|---|---|---|---|---|
| | | | XRD STRUCTURE | Tc (K) | Tg (K) | Tx (K) | ΔTx (K) | Tm (K) |
| COMPARATIVE EXAMPLE | 1 | $Fe_{76.4}Cr_2P_{9.3}C_{2.2}B_{5.7}Si_{4.4}$ | AMORPHOUS | 576 | 794 | 784 | 35 | 1311 |

TABLE 1-continued

| | | | | | | | | |
|---|---|---|---|---|---|---|---|---|
| EXAMPLE | 2 | $Fe_{76.9}Cr_2P_{10.8}C_{2.2}B_{4.2}Si_{3.9}$ | AMORPHOUS | 568 | 739 | 768 | 29 | 1305 |
| EXAMPLE | 3 | $Fe_{77.4}Cr_2P_{10.8}C_{6.8}B_2Si_1$ | AMORPHOUS | 538 | 718 | 743 | 25 | 1258 |
| EXAMPLE | 4 | $Fe_{77.4}Cr_2P_{10.8}C_{6.3}B_2Si_{1.5}$ | AMORPHOUS | 539 | 725 | 748 | 23 | 1282 |
| EXAMPLE | 5 | $Fe_{71.4}Ni_6Cr_2P_{10.8}C_{6.8}B_2Si_1$ | AMORPHOUS | 571 | 703 | 729 | 26 | 1246 |
| EXAMPLE | 6 | $Fe_{71.4}Ni_6Cr_2P_{10.8}C_{7.8}B_2$ | AMORPHOUS | 551 | 701 | 729 | 28 | 1242 |
| EXAMPLE | 7 | $Fe_{73.4}Cr_2Ni_3Sn_1P_{10.8}C_{8.8}B_1$ | AMORPHOUS | 539 | 695 | 730 | 35 | 1258 |
| EXAMPLE | 44 | $Fe_{72.4}Ni_6Cr_1P_{10.8}C_{7.8}B_2$ | AMORPHOUS | 574 | 698 | 725 | 27 | 1242 |

| | | ALLOY CHARACTERISTICS | | | | CORE CHARACTERISTICS* | | |
|---|---|---|---|---|---|---|---|---|
| | No. | Tg/Tm | Tx/Tm | Is (T) | σs ($\times 10^{-6}$ Wbm/kg) | OPTIMUM HEAT TREATMENT TEMPERATURE (K) | W 25 mT, 100 kHz ($kW/m^3$) | μ |
| COMPARATIVE EXAMPLE | 1 | 0.571 | 0.598 | 1.41 | 196 | 743.15 | 100 | 25.5 |
| EXAMPLE | 2 | 0.566 | 0.589 | 1.35 | 188 | 693.15 | 89 | 24.7 |
| EXAMPLE | 3 | 0.571 | 0.591 | 1.30 | 180 | 693.15 | 78 | 25.2 |
| EXAMPLE | 4 | 0.566 | 0.583 | 1.29 | 179 | 693.15 | 86 | 24.4 |
| EXAMPLE | 5 | 0.564 | 0.585 | 1.27 | 174 | 673.15 | 60 | 24.3 |
| EXAMPLE | 6 | 0.564 | 0.587 | 1.27 | 174 | 643.15 | 57 | 25.9 |
| EXAMPLE | 7 | 0.552 | 0.58 | 1.22 | 167 | 633.15 | 60 | 18.6 |
| EXAMPLE | 44 | 0.562 | 0.584 | 1.32 | 183 | 643.15 | 60 | 25.0 |

25

TABLE 2

| | No. | COMPOSITION | AMOUNT OF B (at %) | AMOUNT OF Si (at %) | ALLOY CHARACTERISTICS XRD STRUCTURE | Tc (K) |
|---|---|---|---|---|---|---|
| EXAMPLE | 9 | $Fe_{77.4}Cr_2P_{10.8}C_{9.8}$ | 0 | 0 | AMORPHOUS | 537 |
| EXAMPLE | 10 | $Fe_{77.4}Cr_2P_{10.8}C_{8.8}B_1$ | 1 | 0 | AMORPHOUS | 533 |
| EXAMPLE | 11 | $Fe_{77.4}Cr_2P_{10.8}C_{7.8}B_1Si_1$ | 1 | 1 | AMORPHOUS | 535 |
| EXAMPLE | 12 | $Fe_{77.4}Cr_2P_{10.8}C_{7.8}B_2$ | 2 | 0 | AMORPHOUS | 536 |
| EXAMPLE | 3 | $Fe_{77.4}Cr_2P_{10.8}C_{6.8}B_2Si_1$ | 2 | 1 | AMORPHOUS | 538 |
| EXAMPLE | 4 | $Fe_{77.4}Cr_2P_{10.8}C_{6.3}B_2Si_{1.5}$ | 2 | 1.5 | AMORPHOUS | 539 |
| EXAMPLE | 13 | $Fe_{77.4}Cr_2P_{10.8}C_{5.8}B_2Si_2$ | 2 | 2 | AMORPHOUS | 544 |
| EXAMPLE | 14 | $Fe_{77.4}Cr_2P_{10.8}C_{6.8}B_3Si_1$ | 3 | 1 | AMORPHOUS | 540 |
| EXAMPLE | 15 | $Fe_{77.4}Cr_2P_{10.8}C_{6.8}B_3$ | 3 | 0 | AMORPHOUS | 534 |
| COMPARATIVE EXAMPLE | 16 | $Fe_{76.4}Cr_2P_{10.8}C_{2.2}B_{3.2}Si_{5.4}$ | 3.2 | 5.4 | AMORPHOUS | 569 |
| EXAMPLE | 2 | $Fe_{76.9}Cr_2P_{10.8}C_{2.2}B_{4.2}Si_{3.9}$ | 4.2 | 3.9 | AMORPHOUS | 568 |
| COMPARATIVE EXAMPLE | 17 | $Fe_{76.4}Cr_2P_{10.8}C_{2.2}B_{4.2}Si_{4.4}$ | 4.2 | 4.4 | AMORPHOUS | 567 |

| | | ALLOY CHARACTERISTICS | | | | | | | |
|---|---|---|---|---|---|---|---|---|---|
| | No. | Tg (K) | Tx (K) | ΔTx (K) | Tm (K) | Tg/Tm | Tx/Tm | Is (T) | σs ($\times 10^{-6}$ Wbm/kg) |
| EXAMPLE | 9 | 682 | 718 | 36 | 1254 | 0.544 | 0.573 | 1.34 | 186 |
| EXAMPLE | 10 | 708 | 731 | 23 | 1266 | 0.559 | 0.577 | 1.3 | 181 |
| EXAMPLE | 11 | 710 | 737 | 23 | 1267 | 0.564 | 0.582 | 1.28 | 178 |
| EXAMPLE | 12 | 710 | 742 | 31 | 1277 | 0.557 | 0.581 | 1.28 | 178 |
| EXAMPLE | 3 | 718 | 743 | 25 | 1258 | 0.571 | 0.591 | 1.3 | 180 |
| EXAMPLE | 4 | 725 | 748 | 23 | 1282 | 0.566 | 0.583 | 1.29 | 179 |
| EXAMPLE | 13 | 721 | 747 | 26 | 1284 | 0.562 | 0.582 | 1.28 | 178 |
| EXAMPLE | 14 | 723 | 752 | 29 | 1294 | 0.559 | 0.581 | 1.32 | 183 |
| EXAMPLE | 15 | 717 | 750 | 33 | 1293 | 0.555 | 0.580 | 1.27 | 176 |
| COMPARATIVE EXAMPLE | 16 | 741 | 774 | 33 | 1296 | 0.572 | 0.597 | 1.35 | 188 |
| EXAMPLE | 2 | 739 | 768 | 29 | 1305 | 0.566 | 0.589 | 1.35 | 188 |
| COMPARATIVE EXAMPLE | 17 | 745 | 776 | 31 | 1308 | 0.570 | 0.593 | 1.29 | 182 |

TABLE 4

| No. | COMPOSITION | ADDITION AMOUNT OF Sn (at %) | ALLOY CHARACTERISTICS XRD STRUCTURE | Tc (K) | Tg (K) | Tx (K) |
|---|---|---|---|---|---|---|
| 26 | $Fe_{77.4}Cr_2P_{10.8}C_{2.2}B_{4.2}Si_{3.4}$ | 0 | AMORPHOUS | 561 | 742 | 789 |
| 27 | $Fe_{76.4}Sn_1Cr_2P_{10.8}C_{2.2}B_{4.2}Si_{3.4}$ | 1 | AMORPHOUS | 575 | 748 | 791 |
| 28 | $Fe_{75.4}Sn_2Cr_2P_{10.8}C_{2.2}B_{4.2}Si_{3.4}$ | 2 | AMORPHOUS | 575 | 729 | 794 |
| 29 | $Fe_{74.4}Sn_3Cr_2P_{10.8}C_{2.2}B_{4.2}Si_{3.4}$ | 3 | AMORPHOUS | 572 | 738 | 776 |

| No. | ALLOY CHARACTERISTICS ΔTx (K) | Tm (K) | Tg/Tm | Tx/Tm | Is (T) | σs ($\times 10^{-6}$ Wbm/kg) | POWDER CHARACTERISTICS $O_2$ CONCENTRATION (ppm) |
|---|---|---|---|---|---|---|---|
| 26 | 38 | 1301 | 0.570 | 0.606 | 1.29 | 179 | 0.13 |
| 27 | 43 | 1283 | 0.583 | 0.617 | 1.29 | 179 | |
| 28 | 65 | 1296 | 0.563 | 0.613 | 1.27 | 176 | 0.23 |
| 29 | 38 | 1294 | 0.570 | 0.600 | 1.23 | 171 | |

TABLE 5

| | No. | COMPOSITION | AMOUNT OF P (at %) | AMOUNT OF C (at %) | ALLOY CHARACTERISTICS XRD STRUCTURE | Tc (K) | Tg (K) |
|---|---|---|---|---|---|---|---|
| EXAMPLE | 9 | $Fe_{77.4}Cr_2P_{10.8}C_{9.8}$ | 10.8 | 9.8 | AMORPHOUS | 537 | 682 |
| EXAMPLE | 30 | $Fe_{77.4}Cr_2P_{8.8}C_{9.8}B_1Si_1$ | 8.8 | 9.8 | AMORPHOUS | 555 | 682 |
| EXAMPLE | 31 | $Fe_{77.4}Cr_2P_{8.8}C_{9.8}B_2$ | 8.8 | 9.8 | AMORPHOUS | 545 | 700 |
| EXAMPLE | 32 | $Fe_{77.4}Cr_2P_{6.8}C_{9.8}B_3Si_1$ | 6.8 | 9.8 | AMORPHOUS | 565 | 701 |
| EXAMPLE | 33 | $Fe_{77.4}Cr_2P_{6.8}C_{9.8}B_4$ | 6.8 | 9.8 | AMORPHOUS | 563 | 708 |
| EXAMPLE | 10 | $Fe_{77.4}Cr_2P_{10.8}C_{8.8}B_1$ | 10.8 | 8.8 | AMORPHOUS | 533 | 708 |
| EXAMPLE | 12 | $Fe_{77.4}Cr_2P_{10.8}C_{7.8}B_2$ | 10.8 | 7.8 | AMORPHOUS | 536 | 711 |
| EXAMPLE | 34 | $Fe_{77.4}Cr_2P_{10.8}C_{5.8}B_2Si_2$ | 10.8 | 5.8 | AMORPHOUS | 544 | 721 |
| EXAMPLE | 15 | $Fe_{77.4}Cr_2P_{10.8}C_{6.8}B_3$ | 10.8 | 6.8 | AMORPHOUS | 534 | 717 |
| EXAMPLE | 14 | $Fe_{77.4}Cr_2P_{10.8}C_{6.8}B_3Si_1$ | 10.8 | 6.8 | AMORPHOUS | 540 | 723 |
| COMPARATIVE EXAMPLE | 17 | $Fe_{76.4}Cr_2P_{10.8}C_{2.2}B_{4.2}Si_{4.4}$ | 10.8 | 2.2 | AMORPHOUS | 567 | 745 |

| | No. | ALLOY CHARACTERISTICS Tx (K) | ΔTx (K) | Tm (K) | Tg/Tm | Tx/Tm | Is (T) | σs ($\times 10^{-6}$ Wbm/kg) |
|---|---|---|---|---|---|---|---|---|
| EXAMPLE | 9 | 718 | 36 | 1254 | 0.544 | 0.573 | 1.34 | 186 |
| EXAMPLE | 30 | 726 | 44 | 1305 | 0.523 | 0.556 | 1.40 | 194 |
| EXAMPLE | 31 | 729 | 29 | 1303 | 0.537 | 0.559 | 1.40 | 194 |
| EXAMPLE | 32 | 737 | 36 | 1336 | 0.525 | 0.552 | 1.45 | 201 |
| EXAMPLE | 33 | 741 | 33 | 1347 | 0.526 | 0.550 | 1.48 | 206 |
| EXAMPLE | 10 | 731 | 23 | 1266 | 0.559 | 0.577 | 1.30 | 181 |
| EXAMPLE | 12 | 742 | 31 | 1277 | 0.557 | 0.581 | 1.28 | 178 |
| EXAMPLE | 34 | 747 | 26 | 1284 | 0.562 | 0.582 | 1.28 | 178 |
| EXAMPLE | 15 | 750 | 33 | 1293 | 0.555 | 0.580 | 1.27 | 176 |
| EXAMPLE | 14 | 752 | 29 | 1294 | 0.559 | 0.581 | 1.32 | 183 |
| COMPARATIVE EXAMPLE | 17 | 776 | 31 | 1308 | 0.57 | 0.593 | 1.29 | 182 |

TABLE 6

| | No. | COMPOSITION | ADDITION AMOUNT OF Cr (at %) | ALLOY CHARACTERISTICS XRD STRUCTURE | Tc (K) | Tg (K) | Tx (K) |
|---|---|---|---|---|---|---|---|
| EXAMPLE | 35 | $Fe_{73.9}Ni_6P_{10.8}C_{6.3}B_2Si_1$ | 0 | AMORPHOUS | 607 | 695 | 711 |
| | 36 | $Fe_{72.9}Ni_6Cr_1P_{10.8}C_{6.3}B_2Si_1$ | 1 | AMORPHOUS | 587 | 695 | 714 |
| | 37 | $Fe_{71.9}Ni_6Cr_2P_{10.8}C_{6.3}B_2Si_1$ | 2 | AMORPHOUS | 565 | 695 | 716 |

TABLE 6-continued

| | | | | | | | |
|---|---|---|---|---|---|---|---|
| | 38 | $Fe_{70.9}Ni_6Cr_3P_{10.8}C_{6.3}B_2Si_1$ | 3 | AMORPHOUS | 541 | 697 | 719 |
| | 39 | $Fe_{69.9}Ni_6Cr_4P_{10.8}C_{6.3}B_2Si_1$ | 4 | AMORPHOUS | 520 | 697 | 722 |
| | 40 | $Fe_{67.9}Ni_6Cr_6P_{10.8}C_{6.3}B_2Si_1$ | 6 | AMORPHOUS | 486 | 697 | 725 |
| COMPARATIVE | 41 | $Fe_{65.9}Ni_6Cr_8P_{10.8}C_{6.3}B_2Si_1$ | 8 | AMORPHOUS | 475 | 701 | 729 |
| EXAMPLE | 42 | $Fe_{63.9}Ni_6Cr_{10}P_{10.8}C_{6.3}B_2Si_1$ | 10 | AMORPHOUS | 431 | 706 | 740 |
| | 43 | $Fe_{61.9}Ni_6Cr_{12}P_{10.8}C_{6.3}B_2Si_1$ | 12 | AMORPHOUS | 406 | 708 | 742 |

| | | ALLOY CHARACTERISTICS | | | | | | POWDER CHARACTERISTICS |
|---|---|---|---|---|---|---|---|---|
| | No. | ΔTx (K) | Tm (K) | Tg/Tm | Tx/Tm | Is (T) | σs ($\times 10^{-6}$ Wbm/kg) | $O_2$ CONCENTRATION (ppm) |
| EXAMPLE | 35 | 16 | 1240 | 0.560 | 0.573 | 1.44 | 200 | 0.15 |
| | 36 | 19 | 1239 | 0.561 | 0.576 | 1.35 | 188 | 0.12 |
| | 37 | 21 | 1243 | 0.559 | 0.576 | 1.27 | 177 | 0.12 |
| | 38 | 22 | 1249 | 0.558 | 0.576 | 1.22 | 169 | 0.1 |
| | 39 | 25 | 1253 | 0.556 | 0.576 | 1.20 | 166 | 0.11 |
| | 40 | 28 | 1261 | 0.553 | 0.575 | 1.04 | 144 | |
| COMPARATIVE | 41 | 28 | 1271 | 0.552 | 0.574 | 0.89 | 124 | 0.13 |
| EXAMPLE | 42 | 34 | 1279 | 0.552 | 0.579 | 0.70 | 97 | |
| | 43 | 34 | 1290 | 0.549 | 0.575 | 0.58 | 80 | 0.15 |

TABLE 7

| | | | POWDER CHARACTERISTICS | | | | | | CORE CHARACTERISTICS | | |
|---|---|---|---|---|---|---|---|---|---|---|---|
| | | | | GRAIN SIZE | | | SPECIFIC SURFACE | OPTIMUM HEAT TREATMENT | W 25 mT, | | |
| | No. | COMPOSITION | XRD STRUCTURE | $D_{10}$ (μm) | $D_{50}$ (μm) | $D_{90}$ (μm) | AREA ($m^2/g$) | TEMPERATURE (K) | 100 kHz ($kW/m^3$) | μ |
| EXAMPLE | 3 | $Fe_{77.4}Cr_2P_{10.8}C_{6.8}B_2Si_1$ | AMORPHOUS | 4.4 | 11.3 | 29.6 | 0.2 | 693.15 | 78 | 25.2 |
| EXAMPLE | 5 | $Fe_{71.4}Ni_6Cr_2P_{10.8}C_{6.8}B_2Si_1$ | AMORPHOUS | 4.1 | 10.2 | 25.4 | 0.19 | 673.15 | 60 | 24.3 |
| EXAMPLE | 6 | $Fe_{71.4}Ni_6Cr_2P_{10.8}C_{7.8}B_2$ | AMORPHOUS | 3.9 | 10.5 | 31.1 | 0.21 | 643.15 | 57 | 25.9 |

What is claimed is:

1. An Fe-based amorphous alloy represented by a composition formula: $Fe_{100-a-b-c-x-y-z}Ni_aSn_bCr_cP_xC_yB_z$, wherein an addition amount a of Ni satisfies 4 at %≤a≤6 at %, an addition amount b of Sn satisfies 0 at %≤b≤3 at %, an addition amount c of Cr satisfies 0 at %≤c≤6 at %, an addition amount x of P satisfies 6.8 at %≤x≤10.8 at %, an addition amount y of C satisfies 2.2 at %≤y≤9.8 at %, and an addition amount z of B satisfies 0 at %≤z≤4.2 at %, and wherein the alloy has a glass transition temperature (Tg) equal to or lower than 740K.

2. The Fe-based amorphous alloy according to claim 1, wherein only one of Ni and Sn, not both, has an non-zero addition amount.

3. The Fe-based amorphous alloy according to claim 1, wherein the addition amount b of Sn is in a range of 0 to 2 at %.

4. The Fe-based amorphous alloy according to claim 1, wherein the addition amount c of Cr is in a range of 0 to 2 at %.

5. The Fe-based amorphous alloy according to claim 4, wherein the addition amount c of Cr is in a range of 1 to 2 at %.

6. The Fe-based amorphous alloy according to claim 1, wherein the addition amount x of P is in a range of 8.8 to 10.8 at %.

7. The Fe-based amorphous alloy according to claim 1, wherein the addition amount y of C is in a range of 5.8 to 8.8 at %.

8. The Fe-based amorphous alloy according to claim 1, wherein the addition amount z of B is in a range of 0 to 2 at %.

9. The Fe-based amorphous alloy according to claim 8, wherein the addition amount z of B is in a range of 1 to 2 at %.

10. A powder core comprising:

a powder of the Fe-based amorphous alloy according to claim 1; and a binding agent solidifying the powder.

11. A coil-encapsulating powder core comprising:

a powder core formed of a powder of the Fe-based amorphous alloy according to claim 1 and a binding agent solidifying the powder; and a coil encapsulated in the powder core.

12. The Fe-based amorphous alloy according to claim 1, wherein a=6, b=0, c=1, x=10.8, y=7.8, and z=2.

13. The Fe-based amorphous alloy according to claim 1, wherein a=6, b=0, c=2, x=10.8, y=7.8, and z=2.

14. An Fe-based amorphous alloy represented by a composition formula: $Fe_{100-a-b-c-x-y-z}Ni_aSn_bCr_cP_xC_yB_z$, wherein an addition amount a of Ni satisfies 4 at %≤a≤6 at %, an addition amount b of Sn satisfies 0 at %≤b≤3 at %, an addition amount c of Cr satisfies 1 at %≤c≤6 at %, an addition amount x of P satisfies 6.8 at %≤x≤10.8 at %, an addition amount y of C satisfies 2.2 at %≤y≤9.8 at %, and an addition amount z of B satisfies 0 at %≤z≤4.2 at %, wherein the alloy has a glass transition temperature (Tg) equal to or lower than 740K, and a conversion vitrification temperature (Tg/Tm) equal to or greater than 0.52, Tm being a temperature of a melting point of the alloy.

15. An Fe-based amorphous alloy represented by a composition formula: $Fe_{100-a-b-c-x-y-z}Ni_aCr_cP_xC_yB_z$, wherein an addition amount a of Ni is 6 at %, an addition amount c of Cr is 2 at %, an addition amount x of P is 10.8 at %, an addition amount y of C is 7.8 at %, and an addition amount z of B is 2 at %, wherein the alloy has a glass transition temperature (Tg) equal to or lower than 710K, and a conversion vitrification temperature (Tg/Tm) equal to or greater than 0.557, Tm being a temperature of a melting point of the alloy.

16. A powder core comprising:

a powder of the Fe-based amorphous alloy according to claim 15; and a binding agent solidifying the powder, wherein a core loss (W) at 25 mT and 100 kHz is equal to or smaller than 60 $kW/m^3$.

17. A coil-encapsulating powder core comprising:

a powder core formed of a powder of the Fe-based amorphous alloy according to claim 15 and a binding agent solidifying the powder; and a coil encapsulated in the powder core, wherein a core loss (W) at 25 mT and 100 kHz is equal to or smaller than 60 $kW/m^3$.

* * * * *